US008451083B2

(12) United States Patent
Okumura et al.

(10) Patent No.: US 8,451,083 B2
(45) Date of Patent: May 28, 2013

(54) COIL COMPONENT AND METHOD OF MANUFACTURING THE SAME

(75) Inventors: Takeshi Okumura, Tokyo (JP); Tomokazu Ito, Tokyo (JP)

(73) Assignee: TDK Corporation, Tokyo (JP)

( * ) Notice: Subject to any disclaimer, the term of this patent is extended or adjusted under 35 U.S.C. 154(b) by 8 days.

(21) Appl. No.: 13/149,114

(22) Filed: May 31, 2011

(65) Prior Publication Data

US 2011/0291790 A1 Dec. 1, 2011

(30) Foreign Application Priority Data

May 31, 2010 (JP) ..... 2010-124262
May 30, 2011 (JP) ..... 2011-120949
May 30, 2011 (JP) ..... 2011-120950

(51) Int. Cl.
*H01F 5/00* (2006.01)
*H01F 27/28* (2006.01)

(52) U.S. Cl.
USPC ..... 336/200; 336/223; 336/232

(58) Field of Classification Search
USPC ..... 336/200, 223, 232, 192; 29/602.1
See application file for complete search history.

(56) References Cited

U.S. PATENT DOCUMENTS 7,091,816 B1 * 8/2006 Ito et al. ..... 336/200
7,663,225 B2 * 2/2010 Kudo et al. ..... 257/700
2005/0118969 A1 * 6/2005 Shoji ..... 455/213
2007/0040163 A1 * 2/2007 Okuzawa et al. ..... 257/31
2010/0157565 A1 * 6/2010 Yoshida et al. ..... 361/811

FOREIGN PATENT DOCUMENTS

JP 2007-053254 3/2007
JP 2011-014747 1/2011
JP 2011-071457 4/2011
JP 2011-091097 5/2011
WO WO 2006/073029 A1 7/2006

* cited by examiner

*Primary Examiner* — Elvin G Enad
*Assistant Examiner* — Mangtin Lian
(74) *Attorney, Agent, or Firm* — McDermott Will & Emery LLP

(57) ABSTRACT

A coil component is provided with a magnetic substrate made of magnetic ceramic material, a thin-film coil layer containing a coil conductor formed on one principal surface of the magnetic substrate, a plurality of bump electrodes formed on the principal surface of the thin-film coil layer, and an insulating resin layer formed on the principal surface of the thin-film coil layer excluding formation positions of the bump electrodes. Each bump electrode has an exposure surface on a bottom surface and on two side surfaces of a layered product composed of the magnetic substrate, the thin-film coil layer and the insulating resin layer. A corner of the each bump electrode has a notch portion. The insulating resin layer includes a center resin portion provided in a center of the principal surface of the thin-film coil layer and a plurality of corner resin portions provided in the notch portion of each bump electrode.

10 Claims, 20 Drawing Sheets

PRIOR ART

COIL COMPONENT AND METHOD OF MANUFACTURING THE SAME

TECHNICAL FIELD

The present invention relates to a coil component and a method of manufacturing the coil component, and more particularly relates to a structure of a thin-film common mode filter containing a coil conductor and a manufacturing method thereof.

BACKGROUND OF THE INVENTION

In recent years, standards of USB 2.0 and IEEE1394 are widely distributed as high-speed signal transmission interfaces and used in a large number of digital devices such as personal computers and digital cameras. These interfaces adopt the differential transmission method that transmits a differential signal by using a pair of signal lines to realize faster signal transmission than the conventional single end transmission method.

A common mode filter is widely used as a filter to remove noise on a high-speed differential transmission line. The common mode filter has characteristics that the impedance to a differential component of signals transmitted through a pair of signal lines is low and that impedance to a common mode component (common mode noise) is high. Therefore, by inserting the common mode filter into the pair of signal lines, common mode noise can be cut off without substantially attenuating a differential mode signal.

FIG. 20 is a schematic exploded perspective view showing a structure of a conventional surface-mounted common mode filter.

As shown in FIG. 20, a conventional common mode filter 1 includes a thin-film coil layer 2 containing a pair of coil conductors 5, 6 that are mutually electromagnetically coupled and magnetic substrates 3, 4 provided above and below the thin-film coil layer 2 and made of ferrite. Ends of the coil conductors 5, 6 are each connected to external terminal electrodes 7*a* to 7*d* and the external terminal electrodes 7*a* to 7*d* are formed on side surfaces and upper or lower surfaces of the magnetic substrates 3, 4. The external terminal electrodes 7*a* to 7*d* are normally formed by sputtering or plating of the surface of a magnetic substrate.

WO 2006/073029 discloses a terminal electrode structure of a common mode filter. The terminal electrode of the common mode filter has an Ag film formed by applying a conductive paste containing Ag to the surface of a component or by sputtering or vapor deposition and then a metal film of Ni is formed by performing wet type electrolytic plating on the Ag film.

Japanese Patent Application Laid-Open No. 2007-53254 discloses a common mode choke coil having an outer shape of rectangular parallelepiped by successively forming an insulating layer, a coil layer containing a coil conductor, and an external electrode electrically connected to the coil conductor on a silicon substrate by thin-film formation technology. In the common mode choke coil, the external electrode is formed by extending on the upper surface (mounting surface) of the insulating layer. An internal electrode terminal is constituted as an electrode of a multi-layered structure in which a plurality of conductive layers is stacked.

The conventional common mode filter 1 shown in FIG. 20 has a structure in which a thin-film coil layer is sandwiched between two magnetic substrates and thus has not only high magnetic properties and excellent high-frequency properties, but also high mechanical strength. However, the structure of the conventional common mode filter uses upper and lower magnetic substrates made of ferrite and a ferrite substrate is easy to break when thinned too much, making slimming-down of the substrate difficult. Further, the filter is made thicker by two magnetic substrates being stacked so that it has been difficult to provide a lowered chip component. Moreover, a large amount of expensive magnetic materials is used, posing problems of high manufacturing costs and excessive specs of filter performance depending on uses.

In the conventional common mode filter, micro terminal electrodes are formed on the surface of individual chip components by sputtering or the like, posing a problem that it is extremely difficult to form a terminal electrode with high precision. Further, the internal electrode terminal is formed of many stacked conductor layers in a common mode choke coil described in Japanese Patent Application Laid-Open No. 2007-53254 and thus, the probability of a failed electrode being formed is high and a problem of increased manufacturing costs due to an increase in man-hour for the electrode formation is caused.

SUMMARY OF THE INVENTION

It is therefore an object of the present invention to provide a coil component that can be miniaturized, lowered, and manufactured at a low cost while securing desired filter performance. Another object of the present invention is to provide a method of manufacturing a coil component capable of manufacturing such a coil component easily and at a low cost.

To solve the above problems, a coil component according to the present invention comprises a magnetic substrate made of magnetic ceramic material, a thin-film coil layer containing a coil conductor formed on one principal surface of the magnetic substrate, a plurality of bump electrodes formed on the principal surface of the thin-film coil layer, and an insulating resin layer formed on the principal surface of the thin-film coil layer excluding formation positions of the bump electrodes, wherein each bump electrode has an exposure surface on a bottom surface and on two side surfaces of a layered product composed of the magnetic substrate, the thin-film coil layer and the insulating resin layer, the thin-film coil layer contains a plurality of terminal electrodes electrically connected to the coil conductor, and each of the plurality of terminal electrodes is connected to the corresponding bump electrode and has an exposure surface on at least one of the two side surfaces of the layered product.

According to the present invention, a thin-film coil component whose one magnetic substrate is omitted can be provided at a low cost. Moreover, a bump electrode is used as an external terminal electrode and thus, an electrode can be formed with higher precision. Also, an insulating resin layer is provided around the bump electrode so that the bump electrode can be reinforced to prevent peeling of the bump electrode. Further, according to the present invention, the terminal electrodes connected to the bump electrode are provided by embedded in the thin-film coil layer and the terminal electrode is exposed on at least one of two adjacent side surfaces and therefore, the exposure area of side surfaces of each bump electrode can be secured widely and the formation surface of a fillet during surface mounting can adequately be secured.

In the present invention, it is preferable that each terminal electrode has the exposure surface on both of the two side surfaces of the layered product. According to this configuration, the exposure area of the side surfaces of each bump electrode can be secured more widely.

In the present invention, it is preferable that each terminal electrode includes a first electrode portion directly connected to the coil conductor and a second electrode portion connected to the coil conductor via the bump electrode, the first electrode portion have the exposure surface on one of the two side surfaces, and the second electrode portion have the exposure surface on the other of the two side surfaces. According to this configuration, the exposure area of the side surfaces of each bump electrode can be secured more widely, and the notch portion can be formed in the corner of the each bump electrode.

In the present invention, it is preferable that the thin-film coil layer includes a multilayered insulating member containing first and second insulating layers, a first spiral conductor formed on a surface of the first insulating layer, and a second spiral conductor formed on a surface of the second insulating layer, the coil conductor constitutes a common mode filter including the first and second spiral conductors that mutually couple magnetically, and each of the plurality of terminal electrodes is embedded in the multilayered insulating member.

In the present invention, it is also preferable that the thin-film coil layer includes a multilayered insulating member containing first to fourth insulating layers, a first spiral conductor formed on a surface of the first insulating layer, a second spiral conductor formed on a surface of the second insulating layer, a third spiral conductor formed on a surface of the third insulating layer and connected to the first spiral conductor in serial, a fourth spiral conductor formed on a surface of the fourth insulating layer and connected to the second spiral conductor in serial, wherein the coil conductor constitutes a common mode filter including the first to fourth spiral conductors that mutually couple magnetically, and each of the plurality of terminal electrodes is embedded in the multilayered insulating member.

According to this configuration, an insulating layer on which only a lead conductor is formed is eliminated and the formation area of two coil patterns can be approximately doubled only by further increasing an insulating layer. Accordingly, the number of turns of coil formed in one layer can be reduced without changing the total number of turns and instead, DC resistance $R_{DC}$ can be reduced by making the line width of patterns wider so that common mode filter characteristics can be improved. Further, by increasing the total number of insulating layers, the thickness of the terminal electrode can be increased so that the formation of a fillet during surface mounting can further be improved.

Further to solve the above problems, a method of manufacturing a coil component according to the present invention comprises the step of forming a plurality of coil components on a wafer made of magnetic ceramic material and individualizing the plurality of coil components by dicing, wherein the step of forming the plurality of coil components includes the steps of forming a thin-film coil layer containing a coil conductor and terminal electrode member on one principal surface of the wafer, forming a bump electrode member on the principal surface of the thin-film coil layer by plating, forming an insulating resin layer around the bump electrode member by pouring an insulating resin paste onto the principal surface of the thin-film coil layer on which the bump electrode member is formed and hardening the insulating resin paste; and exposing an upper surface of the bump electrode member by polishing or grinding the upper surface of the insulating resin layer, and the step of individualizing the plurality of coil components includes the step of forming bump electrodes having an exposure surface on a bottom surface and two side surfaces by dividing the bump electrode member by the dicing and also forming terminal electrodes of the coil conductor having the exposure surface on at least one of the two side surfaces by dividing the terminal electrode member embedded in the thin-film layer.

According to the present invention, thick terminal electrode embedded in the thin-film coil layer can be formed easily without undergoing a special process. Therefore, a coil component in which the exposure area on the side surfaces of each bump electrode is widely secured and the formation surface of a fillet during surface mounting is adequately secured can be provided.

Further to solve the above problems, a coil component according to the present invention comprises a magnetic substrate made of magnetic ceramic material, a thin-film coil layer containing a coil conductor formed on one principal surface of the magnetic substrate, a plurality of bump electrodes formed on the principal surface of the thin-film coil layer, and an insulating resin layer formed on the principal surface of the thin-film coil layer excluding formation positions of the bump electrodes, wherein each bump electrode has an exposure surface on a bottom surface and on two side surfaces of a layered product composed of the magnetic substrate, the thin-film coil layer and the insulating resin layer, and a corner of the each bump electrode has a notch portion formed thereon.

According to the present invention, a thin-film coil component whose one magnetic substrate is omitted can be provided at a low cost. Moreover, a bump electrode is used as an external terminal electrode and thus, an electrode can be formed with higher precision. Also, an insulating resin layer is provided around the bump electrode so that the bump electrode can be reinforced to prevent peeling of the bump electrode. Further, according to the present invention, each bump electrode is provided in the corner of a layered product and has three electrode surfaces on a bottom surface and on two side surfaces as exposure surfaces so that fixing strength during soldering can be increased.

In the present invention, it is preferable that the insulating resin layer includes a center resin portion provided in a center of the principal surface of the thin-film coil layer and a plurality of corner resin portions provided in the notch portion of the bump electrode in a corner of the principal surface of the thin-film coil layer. If a part of the insulating resin layer is provided in the notch portion, an occurrence of burrs can be prevented when the bump electrode is cut.

In the present invention, it is preferable that the side surfaces of the bump electrode facing the insulating resin layer have a curved shape without edges. The insulating resin layer is formed by pouring a softened resin after bump electrodes are formed and if the bump electrodes have edged corners on the side surfaces, it is difficult to pour a fluid insulating resin around the bump electrodes and bubbles are more likely to be contained. However, if the side surfaces of the bump electrodes are curved, a viscous resin reaches every corner so that a high-quality resin layer containing no bubbles can be formed. Moreover, adhesiveness between the insulating resin layer and the bump electrodes is increased so that reinforcement for the bump electrodes can be increased.

In the present invention, it is preferable that the insulating resin layer is made of a magnetic powder containing resin material, the coil conductor includes first and second spiral conductors that mutually couple magnetically, and the first and second spiral conductors constitute a common mode filter. Accordingly, the insulating resin layer contains a magnetic material and therefore, magnetic coupling of the common mode filter sandwiched between the magnetic substrate and the insulating resin layer can be increased.

Further to solve the above problems, a method of manufacturing a coil component according to the present invention comprises the steps of forming a plurality of coil components on a wafer made of magnetic ceramic material and individualizing the plurality of coil components by dicing, wherein the step of forming the plurality of coil components includes the steps of forming a thin-film coil layer containing a coil conductor on one principal surface of the wafer, forming a bump electrode member having doughnut shape on the principal surface of the thin-film coil layer by plating, forming an insulating resin layer around the bump electrode member by pouring an insulating resin paste onto the principal surface of the thin-film coil layer on which the bump electrode member is formed and hardening the insulating resin paste, and exposing an upper surface of the bump electrode member by polishing or grinding the upper surface of the insulating resin layer, and the step of individualizing the plurality of coil components includes the step of forming bump electrodes having an exposure surface on a bottom surface and two side surfaces by dividing the bump electrode member by the dicing and also forming corner resin portions of the insulating resin layer in corners of the bump electrodes.

According to the present invention, one of upper and lower magnetic substrates used traditionally is omitted and instead, an insulating resin layer is formed and therefore, coil components can be manufactured easily at a low cost. A bump electrode is used as a terminal electrode and the bump electrode is formed by plating and therefore, accuracy of finishing of an external electrode can be improved. Moreover, two side surfaces of the bump electrode are exposed and therefore, fixing strength during soldering can be increased. Further, an occurrence of burrs at edges of the bump electrode can be prevented.

It is preferable that the method of manufacturing a coil component according to the present invention further includes the step of removing edges by performing barrel polishing of an outer surface of each coil component after the plurality of coil components formed on the wafer being individualized, and plating the surface of the bump electrode exposed on the surface of the each coil component. In such a case, coil components resistant to damage such as chipping can be manufactured. Moreover, the surface of the bump electrode exposed on an outer circumferential surface of chip components is plated and thus, the surface of the bump electrode can be made a smooth surface.

Further to solve the above problems, a method of manufacturing a coil component according to the present invention comprises the steps of forming a plurality of coil components on a wafer made of magnetic ceramic material, and individualizing the plurality of coil components by dicing, wherein the step of forming the plurality of coil components includes the steps of forming a thin-film coil layer containing a coil conductor on one principal surface of the wafer, forming a bump electrode member having doughnut shape with a hollow portion on the principal surface of the thin-film coil layer by plating, a plan shape of the hollow portion being rectangle and each corner of the quadrangle being located on cutting lines, forming an insulating resin layer around the bump electrode member including inside the hollow portion by pouring an insulating resin paste onto the principal surface of the thin-film coil layer on which the bump electrode member is formed and hardening the insulating resin paste, and exposing an upper surface of the bump electrode member by polishing or grinding the upper surface of the insulating resin layer, and the step of individualizing the plurality of coil components includes the step of forming bump electrodes having an exposure surface on a bottom surface and two side surfaces by dividing the bump electrode member by the dicing.

If the bump electrode is diced, the aggregate of the circular corner resin portions is ground by the width of the cutting blade and disappears and no residue thereof remains. Therefore, the bump electrode with no corner resin portion and no notch portion can be formed. Further, an occurrence of burrs of bump electrodes can be prevented because the aggregate of the corner resin portions is present during cutting.

In the present invention, it is preferable that the plan shape of the hollow portion is substantially squire, each corner of the squire is located on the cutting lines, and the step of individualizing the plurality of coil components includes the step of grinding and eliminating a part of the insulation resin layer embedded in the hollow portion by dicing. In this case, it is preferable that a length of each side of the squire is set to 0.7 times ($1/\sqrt{2}$) or less of a width of a cutting blade used for the dicing.

As described above, according to the present invention, a coil component that can be miniaturized, lowered, and manufactured at a low cost while securing desired filter performance can be provided. Also according to the present invention, a coil component having a bump electrode whose fixing strength is high and in which no burr arises while being worked on can be provided. Further, according to the present invention, a manufacturing method capable of manufacturing such coil components easily at a low cost can be provided.

BRIEF DESCRIPTION OF THE DRAWINGS

The above and other objects, features and advantages of this invention will become more apparent by reference to the following detailed description of the invention taken in conjunction with the accompanying drawings, wherein.

DETAILED DESCRIPTION OF THE EMBODIMENTS

Preferred embodiments of the present invention will be described in detail below with reference to the accompanying drawings.

Figure 1:
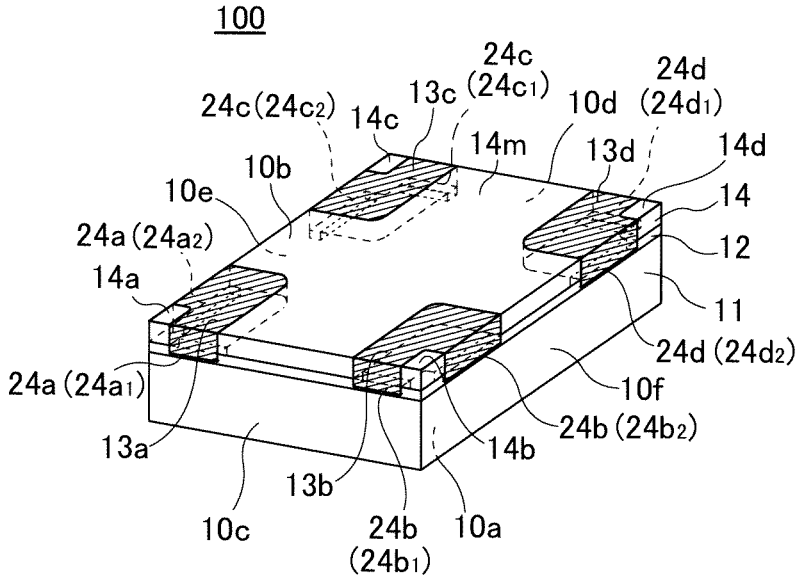
FIG. 1 is a schematic perspective view showing an appearance structure of a coil component 100 according to a first embodiment of the present invention.

FIG. 1 is a schematic perspective view showing an appearance structure of a coil component 100 according to a first embodiment of the present invention.

As shown in FIG. 1, the coil component 100 according to the present embodiment is a common mode filter and includes a magnetic substrate 11, a thin-film coil layer 12 containing a common mode filter element provided on one principal surface of the magnetic substrate 11, first to fourth bump electrodes 13*a* to 13*d* provided on the principal surface of the thin-film coil layer 12, and a magnetic resin layer 14 provided on the principal surface of the thin-film coil layer 12 excluding a formation position of the bump electrodes 13*a* to 13*d*. As illustrated in FIG. 1, the coil component 100 is a surface-mounted chip component in a shape of substantial rectangular parallelepiped and has an upper surface 10*a*, a bottom surface 10*b*, side surfaces 10*c*, 10*d* perpendicular to a longitudinal direction of the chip component, and side surfaces 10*e*, 10*f* in parallel with the longitudinal direction of the chip component. The coil component 100 in FIG. 1 is in a state in which the bottom surface 10*b* (mounting surface) is directed in an upward direction and is turned upside down for mounting to be used with the side of the bump electrodes 13*a* to 13*d* directed in a downward direction.

The magnetic substrate 11 ensures mechanical strength of the coil component 100 and also serves as a closed magnetic circuit of the common mode filter. A magnetic ceramic material, for example, sintered ferrite can be used as the material of the magnetic substrate 11. Though not particularly limited, when the chip size is 0.65×0.50×0.30 (mm), the thickness of the magnetic substrate 11 can be set to about 0.2 mm.

The thin-film coil layer 12 is a layer containing a common mode filter element provided between the magnetic substrate 11 and the magnetic resin layer 14. The thin-film coil layer 12 has, as will be described in detail later, a multi-layered structure formed by an insulating layer and a conductor pattern being alternately stacked. Thus, the coil component 100 according to the present embodiment is a so-called thin-film type and is to be distinguished from a wire wound type having a structure in which a conductor wire is wound around a magnetic core.

The first to fourth bump electrodes 13*a* to 13*d* are external terminal electrodes of the common mode filter element and are exposed to the bottom surface and an outer circumferential surface of a layered product composed of the magnetic substrate 11, the thin-film coil layer 12, and the magnetic resin layer 14. Particularly, the first to fourth bump electrodes 13*a* to 13*d* are provided in corners of the layered product in a shape of rectangular parallelepiped and have three electrode surfaces as exposure surfaces of a bottom surface and two side surfaces of the layered product. Positions of the two electrode surfaces of each bump electrode exposed to the outer circumferential surface of the layered product are different depending on the position of the corner where the bump electrode is formed. The first bump electrode 13*a* has the exposure surfaces on the side surface 10*c* and the side surface 10*e* of the layered product and the second bump electrode 13*b* has the exposure surfaces on the side surface 10*c* and the side surface 10*f* of the layered product. The third bump electrode 13*c* has the exposure surfaces on the side surface 10*d* and the side surface 10*e* of the layered product and the fourth bump electrode 13*d* has the exposure surfaces on the side surface 10*d* and the side surface 10*f* of the layered product.

Figure 20:
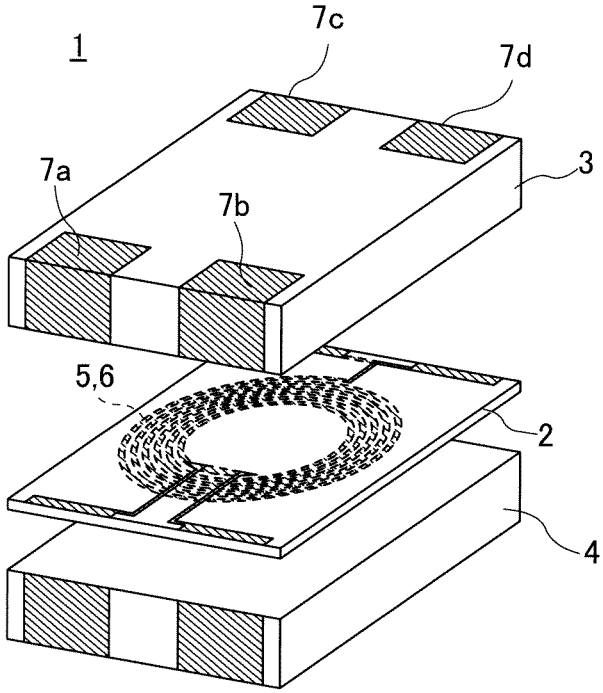
FIG. 20 is a schematic exploded perspective view showing a structure of a conventional surface-mounted common mode filter.

The electrode surface of each of the bump electrodes 13*a* to 13*d* is provided on the bottom surface and one side surface and if an attempt is made to reduce the chip size when composed of two electrode surfaces (see FIG. 20), the distance between adjacent bump electrodes becomes very small, causing a problem of short-circuit through a solder bridge between bump electrodes. However, if a bump electrode is provided in a corner, the distance between bump electrodes can be increased so that a short-circuit through a solder bridge can be prevented. Moreover, the electrode surface of the bump electrode is exposed from two side surfaces orthogonal to each other and thus, a solder fillet formation region can be secured widely and versatilely during soldering so that fixing strength of a chip component onto a printed board can be increased.

The first to fourth bump electrodes 13*a* to 13*d* are formed integrally with corresponding terminal electrodes 24*a* to 24*d* of the common mode filter element formed in the thin-film coil layer 12. That is, each of the terminal electrodes 24*a* to 24*d* in the thin-film coil layer 12 is substantially part of the corresponding bump electrodes 13*a* to 13*d*. Each of the terminal electrodes 24*a* to 24*d* serves to increase the exposure area of two side surfaces held by each of the bump electrodes 13*a* to 13*d* by extending the side surfaces up to the thin-film coil layer 12. Thus, each of the terminal electrodes 24*a* to 24*d* has two exposure surfaces that are provided on the same side surfaces as two exposure surfaces of the corresponding bump electrodes 13*a* to 13*d*.

In the present embodiment, the terminal electrode 24*a* is composed of a combination of an electrode portion (first electrode portion) 24$a_1$ having an exposure surface on a side surface 11*c* and an electrode portion (second electrode portion) 24$a_2$ having an exposure surface on a side surface 11*e* perpendicular to the side surface 11*c* and the terminal electrode 24*b* is composed of a combination of an electrode portion (first electrode portion) 24$b_1$ having an exposure surface on the side surface 11*c* and an electrode portion (second electrode portion) 24$b_2$ having an exposure surface on a side surface 11*f* perpendicular to the side surface 11*c*. Also, the terminal electrode 24*c* is composed of a combination of an electrode portion (first electrode portion) 24$c_1$ having an exposure surface on a side surface 11*d* and an electrode portion (second electrode portion) 24$c_2$ having an exposure surface on the side surface 11*e* perpendicular to the side surface 11*d* and the terminal electrode 24*d* is composed of a combination of an electrode portion (first electrode portion) 24$d_1$ having an exposure surface on the side surface 11*d* and an electrode portion (second electrode portion) 24$d_2$ having an exposure surface on the side surface 11*f* perpendicular to the side surface 11*d*. Thus, an adequate fillet formation surface can be secured for surface mounting by securing the exposure area of the side surface of each of the bump electrodes 13*a* to 13*d* widely.

The magnetic resin layer 14 is a layer constituting a mounting surface of the coil component 100 and protects the thin-film coil layer 12 together with the magnetic substrate 11 and also serves as a closed magnetic circuit of the coil component 100. However, mechanical strength of the magnetic resin layer 14 is weaker than that of the magnetic substrate 11 and plays only a supplementary role in terms of strength. An epoxy resin containing ferrite powder (composite ferrite) can be used as a material of the magnetic resin layer 14. Though not particularly limited, when the chip size is 0.65×0.50×0.30 (mm), the thickness of the magnetic resin layer 14 can be set to about 0.08 to 0.1 mm.

The magnetic resin layer 14 is formed on the principal surface of the thin-film coil layer 12 excluding the formation region of the bump electrodes 13*a* to 13*d* and contains a center resin portion 14*m*provided in the center of the principal surface and four corner resin portions 14*a* to 14*d* provided in the corners of the principal surface. A notch portion (electrode non-forming section) is provided in the corner of each of the bump electrodes 13*a* to 13*d* and the corner resin portions 14*a* to 14*d* are provided in these notch portions. Like the bump electrodes 13*a* to 13*d*, the corner resin portions 14*a* to 14*d* have the exposure surface on the bottom surface and two side surfaces. Thus, the strict formation position of each bump electrode is near the corner of a layered product, rather than in the corner, and a part of the magnetic resin layer 14 is provided in the strict corner of the layered product.

In addition to the original function of the magnetic resin layer 14, the corner resin portions 14*a* to 14*d* have a function to prevent an occurrence of burrs when a bump electrode is cut. The coil component 100 according to the present embodiment is produced by, as will be described later, forming a plurality of common mode filter elements on one magnetic substrate (wafer) and then cutting individual elements for individualization. If, at this point, the entire corner is an electrode surface without the corner resin portion, a burr is more likely to be generated at electrode edges during dicing. It is necessary to remove such burrs, causing a problem of increased manufacturing costs due to an increase in manhour. According to the present embodiment, however, the corner resin portions 14*a* to 14*d* are provided and thus, an occurrence of burrs in the bump electrodes 13*a* to 13*d* can be prevented.

Figure 2:
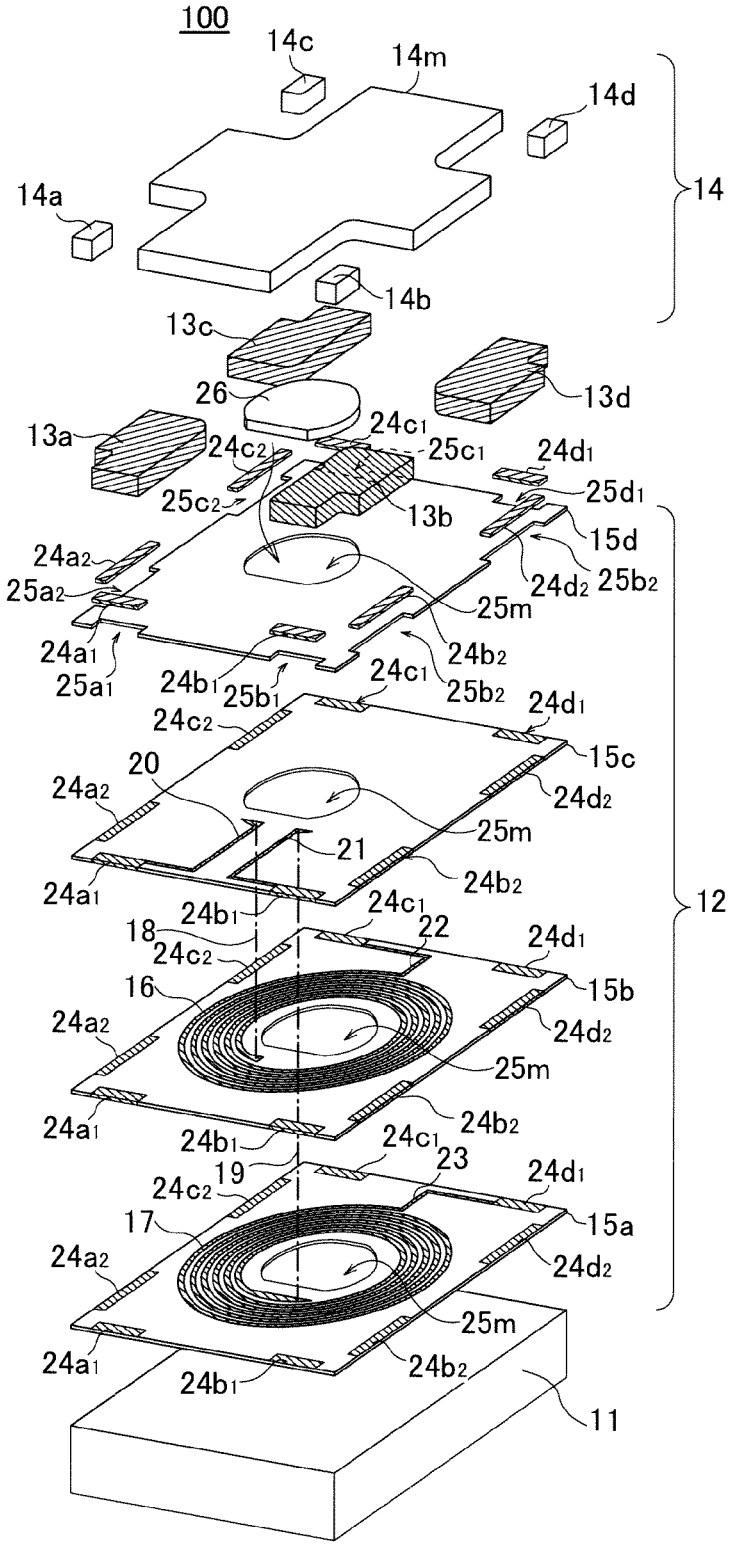
FIG. 2 is a schematic exploded perspective view showing a layer structure of the coil component 100 in detail.

FIG. 2 is a schematic exploded perspective view showing a layer structure of the coil component 100 in detail.

As shown in FIG. 2, the thin-film coil layer 12 includes insulating layers 15*a* to 15*d* stacked in order from the side of the magnetic substrate 11 toward the side of the magnetic resin layer 14, a first spiral conductor 16 formed on the insulating layer 15*b*, a second spiral conductor 17 formed on the insulating layer 15*a*, and first and second lead conductors 20, 21 formed on the insulating layer 15*c*.

The insulating layers 15*a* to 15*d* insulate conductor patterns provided in different layers and also serve to secure flatness of the plane on which conductor patterns are formed. Particularly, the insulating layer 15*a* serves to increase the accuracy of finishing conductor patterns by absorbing unevenness of the surface of the magnetic substrate 11. It is preferable to use a resin excellent in electric and magnetic insulation properties and easy to work on as the material of the insulating layers 15*a* to 15*d* and though not particularly limited, a polyimide resin or epoxy resin can be used.

An internal peripheral end of the first spiral conductor 16 is connected to the first terminal electrode 24$a_1$ via a first contact hole conductor 18 passing through the insulating layer 15*c* and the first lead conductor 20. An external peripheral end of the first spiral conductor 16 is connected to the third terminal electrode 24$c_1$ via a third lead conductor 22 formed integrally with the first spiral conductor 16 on the insulating layer 15*b*.

The internal peripheral end of the second spiral conductor 17 is connected to the second terminal electrode 24$b_1$ via a second contact hole conductor 19 passing through the insulating layers 15*c* and 15*b* and the second lead conductor 21. The external peripheral end of the second spiral conductor 17 is connected to the fourth terminal electrode 24$d_1$ via a fourth lead conductor 23 formed integrally with the second spiral conductor 17 on the insulating layer 15*a*.

The first and the second spiral conductors 16, 17 have the same plane shape and are provided in the same position in plane view. The first and the second spiral conductors 16, 17 overlap completely and thus, strong magnetic coupling is generated between both conductors. With the above configuration, a conductor pattern in the thin-film coil layer 12 constitutes a common mode filter.

The first and the second spiral conductors 16, 17 have both a circular spiral outer shape. A circular spiral conductor attenuates less at high frequencies and thus can be used preferably as a high-frequency inductance. In the present embodiment, the second lead conductor 21 is provided on the insulating layer 15*c*, which is common to the first lead conductor 20, but may be provided on an insulating layer that is different from that on which the first lead conductor 20 is provided. Further, in the present invention, the positional relationship in the vertical direction between the first and second spiral conductors 16, 17 and the first and second lead conductors 20, 21 is not particularly limited and any positional relationship may be adopted.

An opening 25*m* passing through each of the insulating layers 15*a* to 15*d* is provided in a central region of each of the insulating layers 15*a* to 15*d* and on an inner side of the first and second spiral conductors 16, 17 and a magnetic core 26 to form a magnetic circuit is formed inside the opening 25*m*. It is preferable to use a magnetic powder containing resin (composite ferrite), which is the same material as that of the magnetic resin layer 14, as the material of the magnetic core 26. If the material of the magnetic core 26 is the same material as that of the magnetic resin layer 14, the magnetic core 26 is formed integrally with the magnetic resin layer 14 by a part of the material of the magnetic resin layer 14 being embedded inside the opening 25*m*, but FIG. 2 illustrates the magnetic core 26 and the magnetic resin layer 14 in a separated state.

a pair of electrode portions 24$a_1$ and 24$a_2$ corresponding to the first bump electrode 13*a*, a pair of electrode portions 24$b_1$ and 24$b_2$ corresponding to the second bump electrode 13*b*, a pair of electrode portions 24$c_1$ and 24$c_2$ corresponding to the third bump electrode 13*c*, and a pair of electrode portions 24$d_1$ and 24$d_2$ corresponding to the first bump electrode 13*d* are provided on the circumferential edge of each of the insulating layers 15*a* to 15*d* respectively. Among these electrode portions, the pair of the electrode portions 24$a_1$ to 24$d_1$ and 24$a_2$ to 24$d_2$ formed on the insulating layer 15*a* is formed on the surface of the insulating layer 15*a* and does not penetrate the insulating layer 15*a*.

In contrast, the electrode portions 24$a_1$ to 24$d_1$ and 24$a_2$ to 24$d_2$ formed on each of the insulating layers 15*b*, 15*c* and 15*d* are embedded in corresponding openings 25$a_1$ to 25$d_1$ and 25$a_2$ to 25$d_2$ and the electrode portions penetrate the insulating layers 15*b*, 15*c* and 15*d*. However, FIG. 2 illustrate that only electrode portions of the insulating layer 15*b* and 15*c* are embedded in the openings 25$a_1$ to 25$d_1$ and 25$a_2$ to 25$d_2$ and reference numerals of the openings are omitted.

The electrode portions of the insulating layers 15*b* and 15*c* are formed by filling inside the openings with conductor, and peculiarly, the electrode portions are formed in the same process of forming contact hall conductors 18 and 19. Each opening has a hollow portion exposed on the side surface and thus has substantially a notch structure.

The electrode portions 24$a_1$ to 24$d_1$ and 24$a_2$ to 24$d_2$ formed on the insulating layers 15*b*, 15*c* and 15*d* are also embedded in corresponding openings 25$a_1$ to 25$d_1$ and 25$a_2$ to 25$d_2$. These electrode portions are formed in the process of forming the bump electrodes 13*a* to 13*d*. Although it is illustrated in FIG. 2 that the electrode portions 24$a_1$ to 24$d_1$ and 24$a_2$ to 24$d_2$ of the insulating layers 15*d* are not embedded in the openings 25$a_1$ to 25$d_1$ and 25$a_2$ to 25$d_2$ and separated from the bump electrodes 13*a* to 13*d*. However, actual electrode portions 24$a_1$ to 24$d_1$ and 24$a_2$ to 24$d_2$ are embedded inside the openings and integrated with corresponding bump electrodes 13*a* to 13*d*. The meaning of "integration" includes the state where the bump electrodes and the electrode portions are in contact so as at least to ensure electrical connection with each other.

The terminal electrode 24*a* has the electrode portion 24$a_1$ exposed on the side surface 10*c* and the electrode portion 24$a_2$ exposed on the side surface 10*e* and the electrode portion 24$a_1$ is connected to the spiral conductor 16 via the lead conductor 20 and the through hole conductor 18. That is, the electrode portion 24$a_1$ is directly connected to the spiral conductor 16. By contrast, the other electrode portion 24$a_2$ is not directly connected to the lead conductor 20 and is connected to the lead conductor 20 via the corresponding bump electrode 13*a* and the electrode portion 24$a_1$. That is, the electrode portion 24$a_2$ is not directly connected to the spiral conductor 16.

The terminal electrode 24*b* has the electrode portion 24$b_1$ exposed on the side surface 10*c* and the electrode portion 24$b_2$ exposed on the side surface 10*e* and the electrode portion 24$b_1$ is connected to the spiral conductor 17 via the lead conductor 20 and the through hole conductor 18. That is, the electrode portion 24$b_1$ is directly connected to the spiral conductor 17. By contrast, the other electrode portion 24$b_2$ is not directly connected to the lead conductor 20 and is connected to the lead conductor 20 via the corresponding bump electrode 13*b* and the electrode portion 24$b_1$. That is, the electrode portion 24$b_2$ is not directly connected to the spiral conductor 17.

The terminal electrode 24*c* has the electrode portion 24$c_1$ exposed on the side surface 10*c* and the electrode portion 24$c_2$ exposed on the side surface 10*e* and the electrode portion 24$c_1$ is connected to the spiral conductor 16 via the lead conductor 20 and the through hole conductor 18, but the other electrode portion 24$c_2$ is not directly connected to the lead conductor 20 and is connected to the lead conductor 20 via the corresponding bump electrode 13*c* and the electrode portion 24$c_1$.

The terminal electrode 24*d* has the electrode portion 24$d_1$ exposed on the side surface 10*c* and the electrode portion 24$d_2$ exposed on the side surface 10*e* and the electrode portion 24$d_1$ is connected to the spiral conductor 16 via the lead conductor 20 and the through hole conductor 18, but the other electrode portion 24$d_2$ is not directly connected to the lead conductor 20 and is connected to the lead conductor 20 via the corresponding bump electrode 13*d* and the electrode portion 24$d_1$.

The terminal electrode is embedded inside an opening of the thin-film coil layer 12 and exposed through two adjacent side surfaces like in the present embodiment, the exposure area of side surfaces of each of the bump electrodes 13*a* to 13*d* can therefore be secured widely and the formation surface of a fillet during surface mounting can adequately be secured. Moreover, a terminal electrode of a common mode filter element can be formed simultaneously with a bump electrode without undergoing a special process.

The first to fourth bump electrodes 13*a* to 13*d* are provided on the insulating layer 15*d*. The first bump electrode 13*a* is connected to an end of the first lead conductor 20 via the terminal electrode 24$a_1$, the second bump electrode 13*b* is connected to an end of the second lead conductor 21 via the terminal electrode 24$b_1$, the third bump electrode 13*c* is connected to an end of the third lead conductor 22 via the terminal electrode 24*c* and the fourth bump electrode 13*d* is connected to an end of the fourth lead conductor 23 via the terminal electrode 24$d_1$. The "bump electrode" herein means, in contrast to an electrode formed by thermally compressing a metal ball of Cu, Au or the like using a flip chip bonder, a thick-film plated electrode formed by plating. Though not particularly limited, it is preferable to use Cu as the material of the bump electrode. The thickness of the bump electrode is equal to the thickness of the magnetic resin layer 14 or more and can be set to about 0.08 to 0.1 mm. That is, the bump electrodes 13*a* to 13*d* are thicker than a conductor pattern inside the thin-film coil layer 12 and particularly have five times the thickness of the conductor pattern inside the thin-film coil layer 12 or more.

The magnetic resin layer 14 is formed on the insulating layer 15*d* on which the first to fourth bump electrodes 13*a* to 13*d* are formed. The magnetic resin layer 14 is composed of, as described above, the center resin portion 14*m* and the four corner resin portions 14*a* to 14*d* and is provided as if to cover surroundings of the bump electrodes 13*a* to 13*d*.

Figure 3:
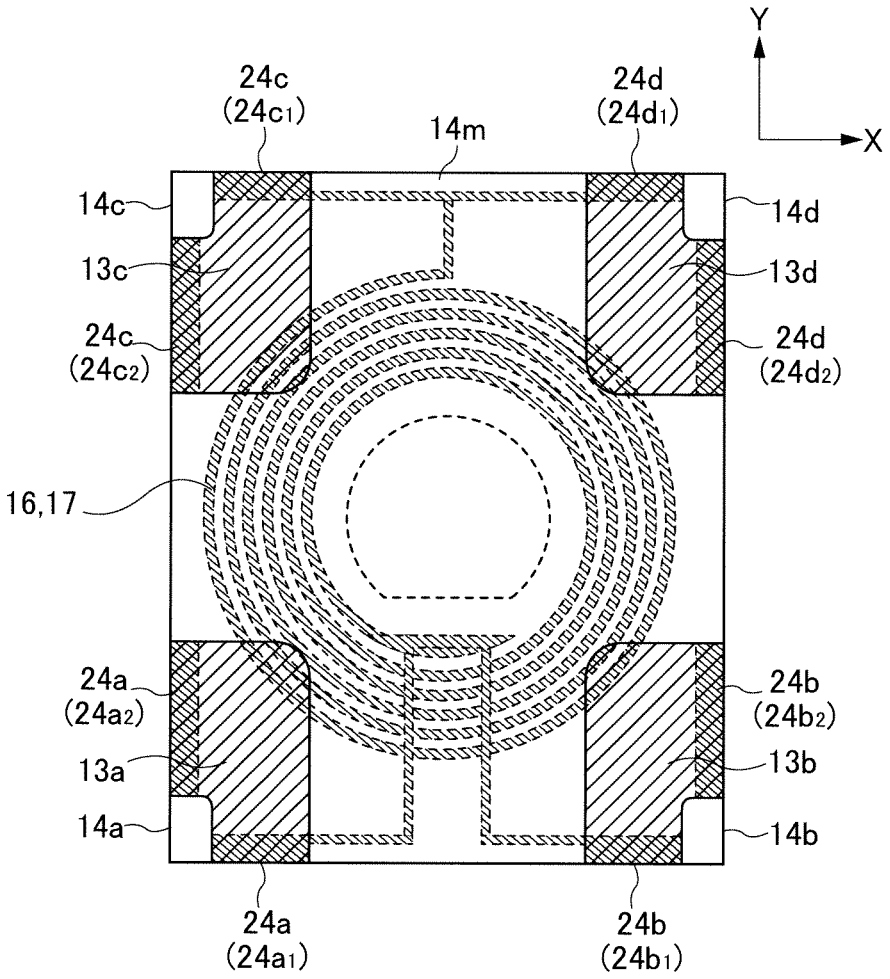
FIG. 3 is a schematic plan view showing a spatial relationship between a conductor pattern in the thin-film coil layer 12 and the bump electrodes 13*a* to 13*d;*

FIG. 3 is a schematic plan view showing a spatial relationship between a conductor pattern in the thin-film coil layer 12 and the bump electrodes 13*a* to 13*d*.

As shown in FIG. 3*a*, the first and the second spiral conductors 16, 17 overlap completely in plane view and thus, strong magnetic coupling is generated between both conductors. Also in the present embodiment, a part of the first to fourth bump electrodes 13*a* to 13*d* overlaps with the spiral conductors 16, 17. It is necessary to secure a certain size of the mounting surface of the bump electrodes 13*a* to 13*d* to ensure soldering to a printed board and if the bump electrodes 13*a* to 13*d* are arranged so as to overlap with the spiral conductors 16, 17, the electrode area can be secured without increasing the chip area.

Also as illustrated in FIG. 3*a*, portions of side surfaces of the bump electrodes 13*a* to 13*d* facing the center resin portion 14*m* or the corner resin portions 14*a* to 14*d* of the magnetic resin layer 14 preferably have curved shape without edge. As will be described in detail later, after the bump electrodes 13 are formed, the magnetic resin layer 14 is formed by pouring a paste of composite ferrite and if, at this point, the bump electrodes 13*a* to 13*d* have edged corners on the side surfaces thereof, surroundings of bump electrodes are not completely packed with the paste and bubbles are more likely to be contained. However, if the side surfaces of the bump electrodes 13*a* to 13*d* are curved, a fluid resin reaches every corner so that a closely packed insulating resin layer containing no bubbles can be formed. Moreover, adhesiveness between the magnetic resin layer 14 and the bump electrodes 13*a* to 13*d* is increased so that reinforcement for the bump electrodes 13*a* to 13*d* can be increased.

As described above, the coil component 100 according to the present embodiment has the magnetic substrate 11 provided only on one side of the thin-film coil layer 12 to omit an insulating substrate on the opposite side and the magnetic resin layer 14 provided instead thereof and thus can provide a thin-film chip component at a low cost. Also, by providing the bump electrodes 13*a* to 13*d* that are as thick as the magnetic resin layer 14, a process to form an external electrode surface on the side surface or the upper or lower surface of a chip component can be omitted so that an external electrode can be formed easily with high precision. Further, according to the present embodiment, a part of the bump electrodes 13*a* to 13*d* is provided so as to overlap with a coil conductor pattern in plane view so that miniaturization of chip components can be attempted.

Further, bump electrodes of the coil component 100 according to the present embodiment are provided near corners of a chip component and each bump electrode has three electrode surfaces of one bottom surface and two side surfaces of a layered product for exposure and thus, fixing strength to a printed board during soldering can be increased and also the problem of a solder bridge between adjacent bump electrodes can be avoided. If the surface of a bump electrode is formed on all of three surfaces in a corner, a burr is more likely to be generated while being cut thereon, but with a notch portion provided in the corner of the bump electrode and the corner resin portions 14*a* to 14*d* provided in the notch portion, an occurrence of burrs while the bump electrode being cut on can be prevented.

Next, the method of manufacturing the coil component 100 will be described in detail. In the manufacture of the coil component 100, a mass production process to manufacture a large number of chip components is performed in which a large number of common mode filter elements (coil conductor patterns) are formed on a large magnetic substrate (magnetic wafer) and then, each element is individually cut.

Figure 4:
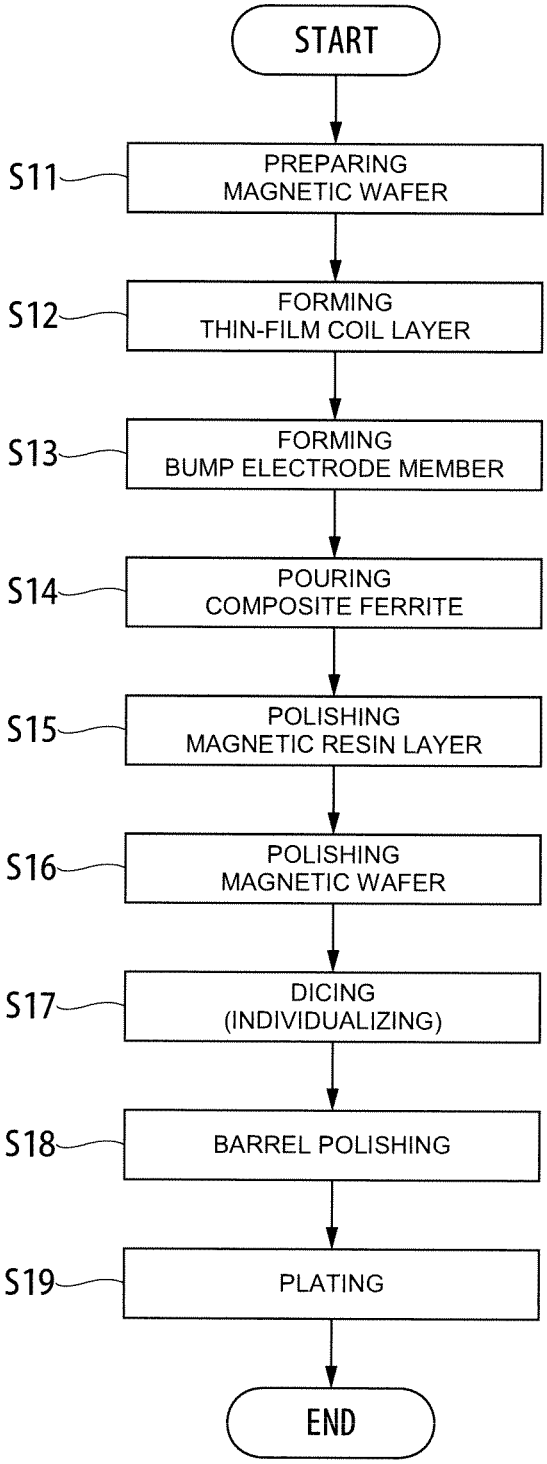
FIG. 4 is a flow chart showing a method of manufacturing the coil component 100.
Figure 5A:
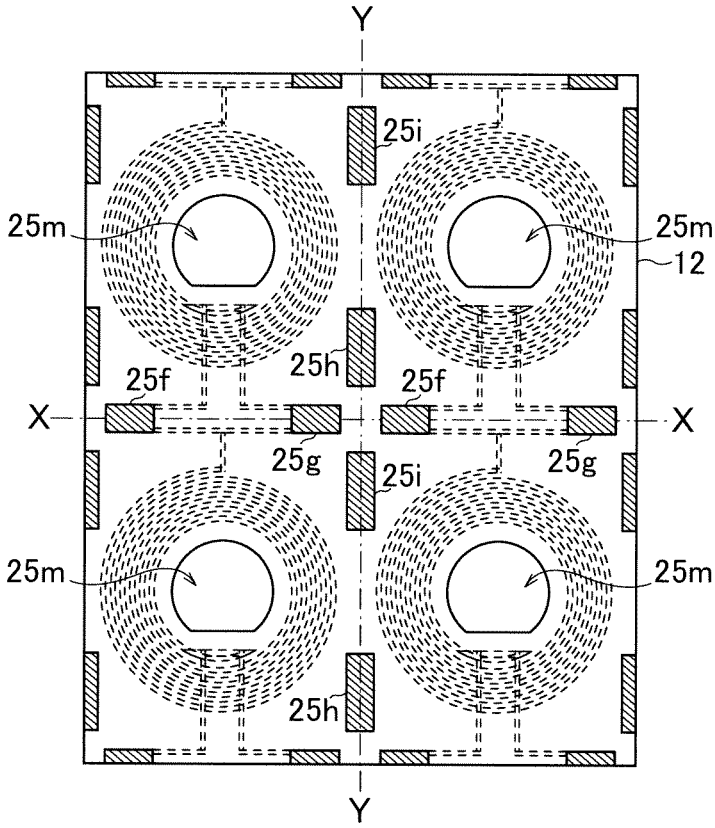
FIG. 5A is a plan view showing the manufacturing method of the coil component 100.
Figure 5B:
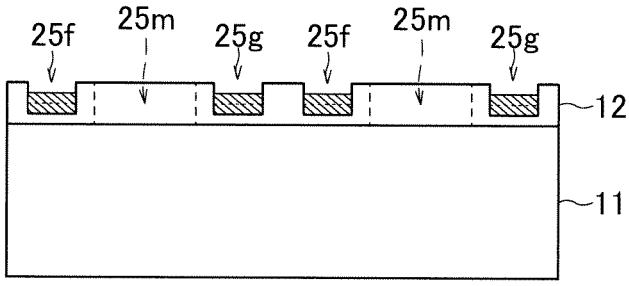
FIG. 5B is a cross-sectional view along an X-X line in FIG. 5A.

FIG. 4 is a flow chart showing a method of manufacturing the coil component 100. FIGS. 5 to 11 are diagrams showing the manufacturing method of the coil component 100, FIGS. 5A to 11A are plan views, and FIGS. 5B to 12B are cross-sectional view along an X-X line in FIGS. 5A to 11A.

As shown in FIGS. 4 and 5, for the manufacture of the coil component 100, the magnetic wafer 11 is first prepared (step S11) and then the thin-film coil layer 12 on which a large number of common mode filter elements are laid out on the surface of the magnetic wafer 11 is formed (step S12).

The thin-film coil layer 12 is formed by the so-called thin-film technology. The thin-film technology is a method in which a multilayer film in which an insulating film and a conductor layer are alternately formed is formed by repeating a process in which a photosensitive resin is applied to form an insulating layer by exposure and development and a conductor pattern is formed on the surface of the insulating layer. The formation process of the thin-film coil layer 12 will be described in detail below.

In the formation of the thin-film coil layer 12, the insulating layer 15*a* is first formed and then, the second spiral conductor 17, lead conductor 23 and the terminal electrodes 24*a* to 24*d* are formed on the surface of the insulating layer 15*a* and further, the contact hole conductor 19 passing through the insulating layer 15*a* is formed. Next, after the insulating layer 15*b* being formed on the insulating layer 15*a*, the first spiral conductor 16 and lead conductor 22 are formed on the surface of the insulating layer 15*b* and further, the contact hole conductors 18 and 19 and the terminal electrodes 24*a* to 24*d* passing through the insulating layer 15*b* are formed. Next, after the insulating layer 15*c* being formed on the insulating layer 15*b*, the lead conductors 20, 21 are formed on the insulating layer 15*c* and further, the contact hole conductors 18 and 19 and the terminal electrodes 24*a* to 24*d* passing through the insulating layer 15*c* are formed. Lastly, the insulating layer 15*d* is formed to complete the thin-film coil layer 12.

Each of the insulating layers 15*a* to 15*d* can be formed by spin-coating a photosensitive resin on a base surface and exposing and developing the resin layer. Particularly, the insulating layers 15*a* to 15*d* are formed as insulating layers having the opening 25*m*, the insulating layers 15*b*, 15*c* and 15*d* are formed as insulating layers having openings 25*f* to 25*i*, and the insulating layers 15*b*, 15*c* are formed as insulating layers having the contact hole conductors 18 and 19. Terminal electrode materials are embedded into the openings 25*f* to 25*i* of the insulating layers 15*b* and 15*c*. The electrode materials in the openings 25*f* to 25*i* are embedded in the process of forming the contact hole conductors 18 and 19. No electrode material is embedded into the openings 25*f* to 25*i* of the insulating layer 15*d*. Cu or the like can be used as the material of conductor patterns, which can be formed by forming a conductor layer by the vapor deposition or sputtering and then patterning the conductor layer.

The opening 25*f* is formed by integrating an opening $\mathbf{25}a_1$ (see FIG. 2) formed in one chip component of two chip components adjacent in the Y-Y direction and an opening $\mathbf{25}c_1$ formed in the other chip component and the opening $\mathbf{25}a_1$ and the opening $\mathbf{25}c_1$ are formed by the opening 25*f* being cut into two along the X-X line. The opening 25*g* is formed by integrating an opening $\mathbf{25}b_1$ formed in one chip component of two chip components adjacent in the Y-Y direction and an opening $\mathbf{25}d_1$ formed in the other chip component and the opening $\mathbf{25}b_1$ and the opening $\mathbf{25}d_1$ are formed by the opening 25*g* being cut into two along the X-X line.

The opening 25*h* is formed by integrating an opening $\mathbf{25}a_2$ formed in one chip component of two chip components adjacent in the X-X direction and an opening $\mathbf{25}b_2$ in the other chip component and the opening $\mathbf{25}a_2$ and the opening $\mathbf{25}b_2$ are formed by the opening 25*f* being cut into two along the Y-Y line. The opening 25*i* is formed by integrating an opening $\mathbf{25}c_2$ formed in one chip component of two chip components adjacent in the X-X direction and an opening $\mathbf{25}d_2$ in the other chip component and the opening $\mathbf{25}c_2$ and the opening $\mathbf{25}d_2$ are formed by the opening 25*g* being cut into two along the Y-Y line.

Figure 6A:
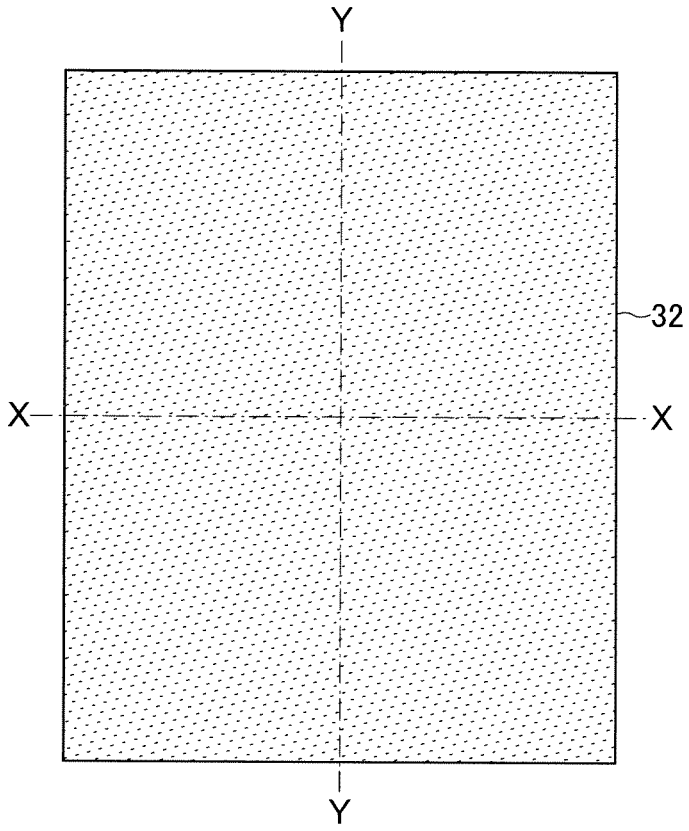
FIG. 6A is a plan view showing the manufacturing method of the coil component 100.
Figure 6B:
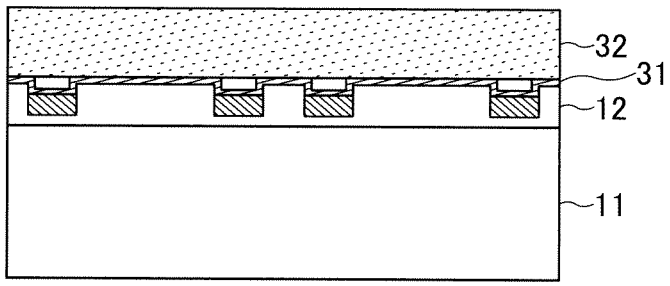
FIG. 6B is a cross-sectional view along an X-X line in FIG. 6A.
Figure 7A:
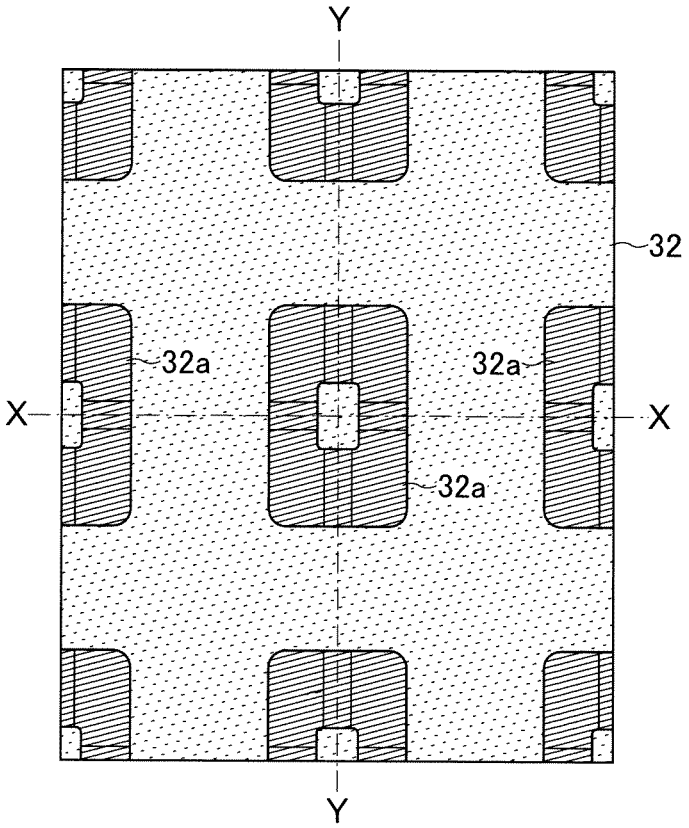
FIG. 7A is a plan view showing the manufacturing method of the coil component 100.
Figure 7B:
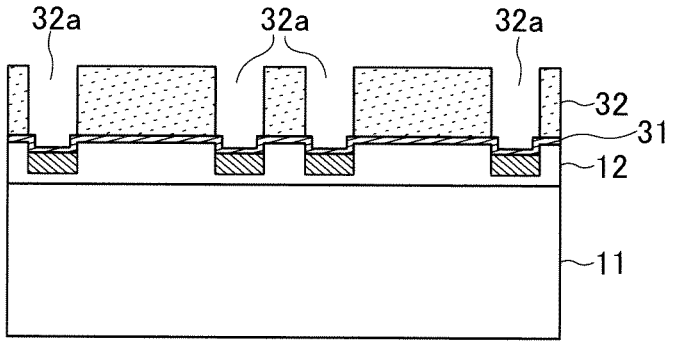
FIG. 7B is a cross-sectional view along an X-X line in FIG. 7A.

Next, a bump electrode member 13 forming the foundation of the bump electrodes 13*a* to 13*d* is formed on the insulating layer 15*d* (step S13). As the formation method of the bump electrode member 13*a*, as shown in FIG. 6, a Cu film 31 is first formed by sputtering over the entire surface of the insulating layer 15*d* where the terminal electrodes 24*a* to 24*d* are exposed and then, a sheet resist 32 is affixed thereto. The Cu film 31 may be formed by non-electrolytic plating or vapor-deposition. In this process, the openings 25*f* to 25*i* (see FIG. 5) of the insulating layer 15*d* is filled with Cu film 31. Next, as shown in FIG. 7, the sheet resist 32 in positions where the bump electrodes 13*a* to 13*d* should be formed is selectively removed by exposure and development of the sheet resist 32 to expose a bump electrode formation region on the insulating layer 15*d*.

An opening pattern 32*a* formed in the sheet resist 32 is a formation region of the bump electrode member common to four chip components allocated therearound and has a substantially annular (doughnut) shape. The region (pattern dark side) where the sheet resist 32 is left behind is a formation region of the magnetic resin layer 14, particularly the resist region left behind around the opening pattern 32*a* is a formation region of the center resin portion 14*m*, and the resist region left behind in the center in the opening pattern 32*a* is a formation region of an aggregate of the corner resin portions 14*a* to 14*d*.

Figure 8A:
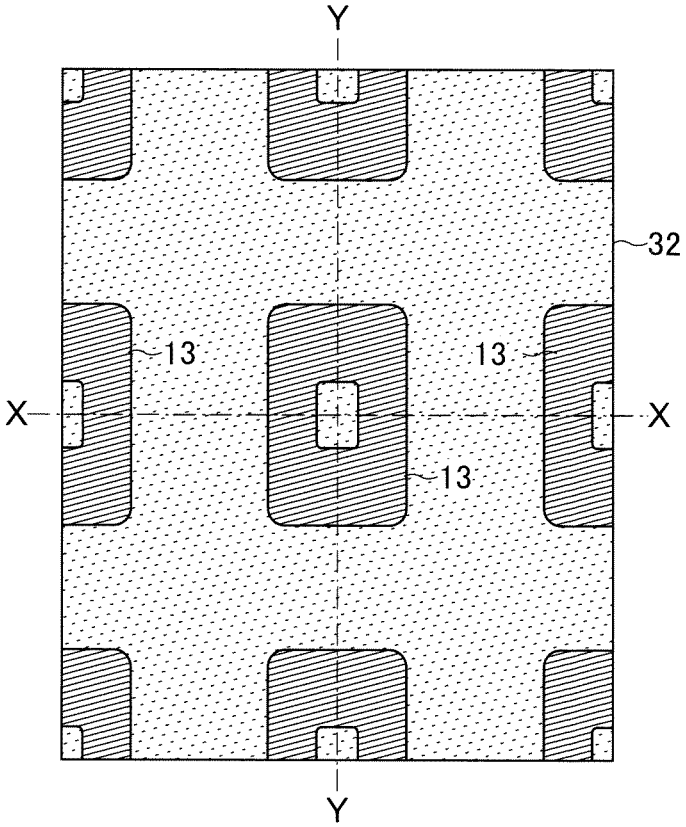
FIG. 8A is a plan view showing the manufacturing method of the coil component 100.
Figure 8B:
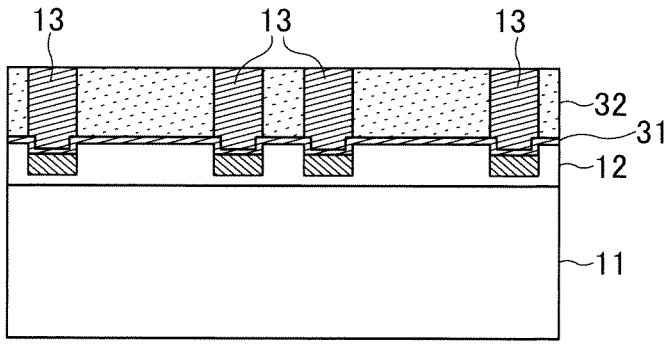
FIG. 8B is a cross-sectional view along an X-X line in FIG. 8A.
Figure 9A:
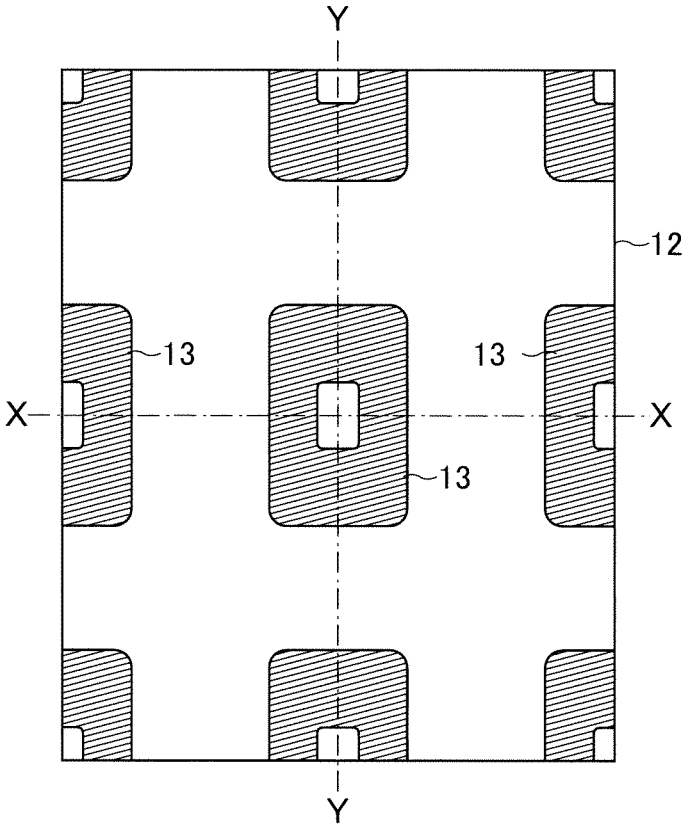
FIG. 9A is a plan view showing the manufacturing method of the coil component 100.
Figure 9B:
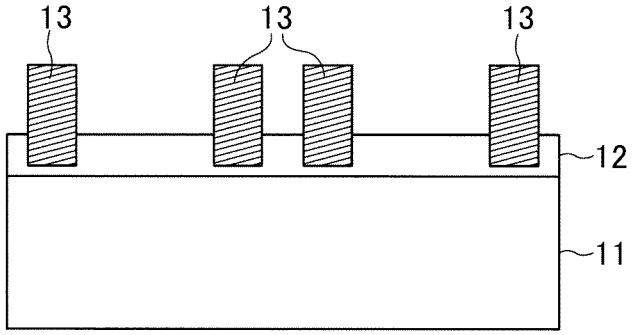
FIG. 9B is a cross-sectional view along an X-X line in FIG. 9A.

Next, as shown in FIG. 8, Cu as a bump electrode material is formed in the exposure region by electroplating. At the same time, Cu film 31 in the openings 25*f* to 25*i* (see FIG. 5) of the insulating layer 15*d* also glows, and the openings are filled with the bump electrode material. Then, as shown in FIG. 9, the bump electrode member 13 in a substantially pillar shape is formed by removing the sheet resist 32 and removing the unnecessary Cu film 31 by performing etching of the entire surface. At this point, the bump electrode member 13 is formed as an electrode member common to four chip components and particularly a hollow portion of the bump electrode member 13 in a doughnut shape is a filling region of the center resin portion common to the four chip components. The bump electrode member 13 is divided into four by dicing described later, thereby forming the individual bump electrodes 13*a* to 13*d* corresponding to each element.

Figure 10A:
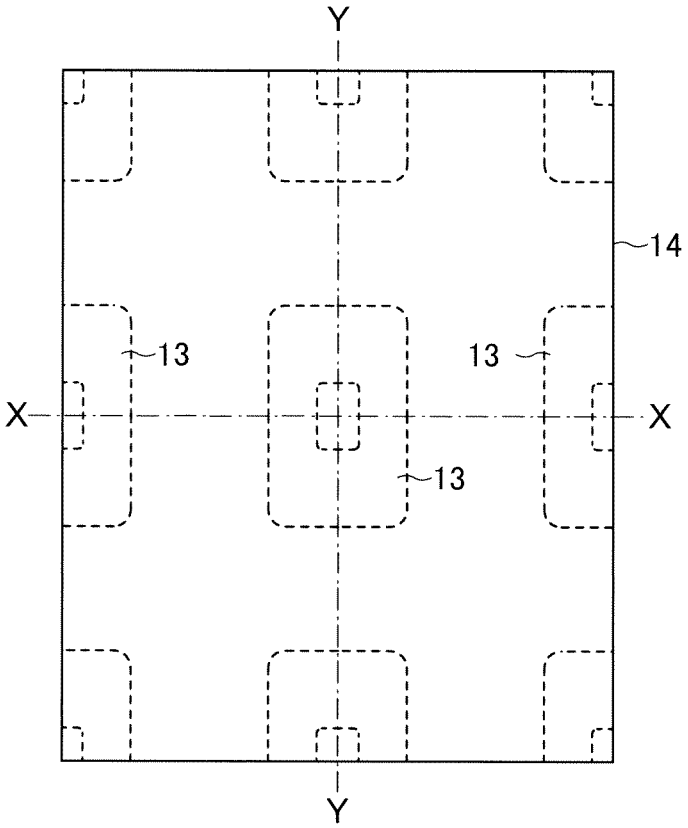
FIG. 10A is a plan view showing the manufacturing method of the coil component 100.
Figure 10B:
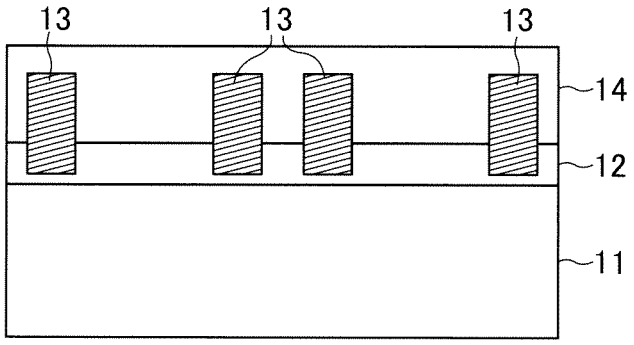
FIG. 10B is a cross-sectional view along an X-X line in FIG. 10A.
Figure 11A:
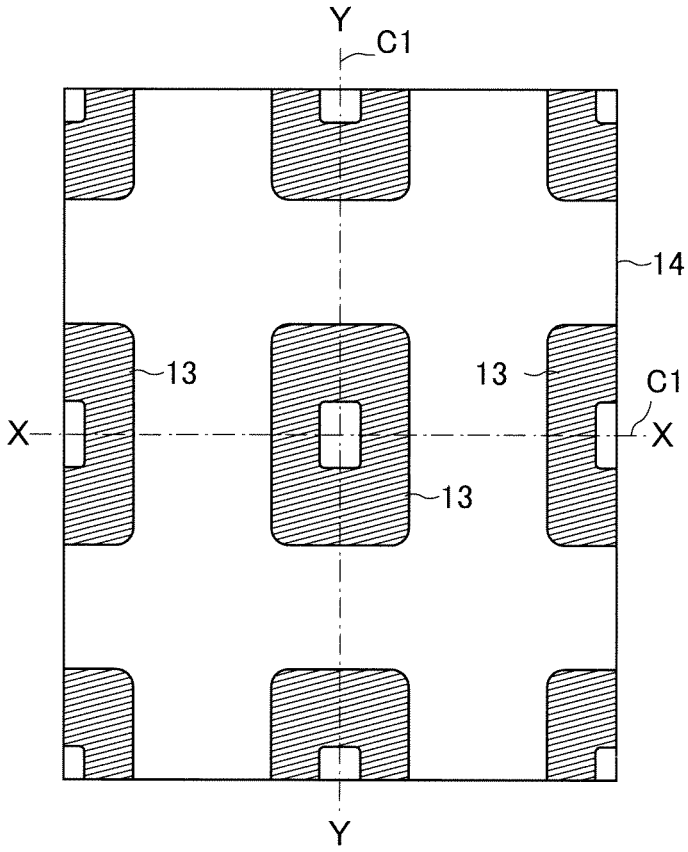
FIG. 11A is a plan view showing the manufacturing method of the coil component 100.
Figure 11B:
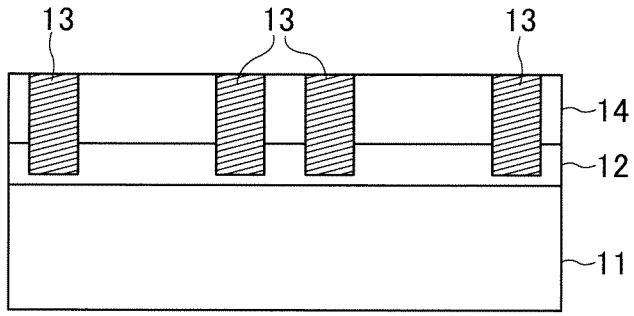
FIG. 11B is a cross-sectional view along an X-X line in FIG. 11A.

Next, as shown in FIG. 10, a paste of composite ferrite is poured onto the magnetic wafer on which the bump electrode members 13 are formed and hardened to form the magnetic resin layer 14 (step S14). At this point, a large amount of paste is poured to reliably form the magnetic resin layer 14, thereby burying the bump electrode members 13 in the resin. Thus, as shown in FIG. 11, the magnetic resin layer 14 is polished until the upper surface of the bump electrode member 13 is exposed to have a predetermined thickness and also to make the surface thereof smooth (step S15). Further, the magnetic wafer 11 is also polished to have a predetermined thickness (step S16).

Next, each common mode filter element is individualized (made a chip) by dicing of the magnetic wafer (step S17). As shown in FIG. 11, cutting lines C1 extending in a longer direction (Y direction) and a shorter direction (X direction) of a chip component pass through the center of the bump electrode member 13 in a doughnut shape and across section of the obtained bump electrodes 13*a* to 13*d* is exposed on two side surfaces orthogonal to each other of the coil component 100. Moreover, terminal electrode member is divided by dicing whereby the terminal electrodes 24*a* to 24*d* having an exposure surface on two side surfaces of a layered product are formed. The two side surfaces (including side surfaces of terminal electrodes) of the bump electrodes 13*a* to 13*d* become a formation surface of a solder fillet during mounting thus, the solder fillet formation region can be secured widely and versatilely so that fixing strength during soldering can be increased.

Next, after edges being removed by performing barrel polishing of chip components (step S18), electroplating is performed (step s19) to smooth the surface of the bump electrodes 13*a* to 13*d* and the terminal electrodes 24*a* to 24*d* exposed on the side surfaces of the thin-film coil layer 12, thereby completing the bump electrodes 13*a* to 13*d* shown in FIG. 1. By performing barrel polishing of the outer surface of chip components as described above, coil components resistant to damage such as chipping can be manufactured. The surface of the bump electrodes 13*a* to 13*d* exposed on an outer circumferential surface of chip components is plated and thus, the surface of the bump electrodes 13*a* to 13*d* can be made a smooth surface.

As described above, according to the method of manufacturing the coil component 100 in the present embodiment, one of upper and lower magnetic substrates used traditionally is omitted and instead, an insulating resin layer is formed and therefore, coil components can be manufactured easily at a low cost. Moreover, a resin is packed around a bump electrode and therefore, the bump electrode can be reinforced to prevent peeling of the bump electrode or the like. Also, according to the method of manufacturing common mode filters in the present embodiment, a bump electrode is formed by plating and therefore, compared with formation by, for example, sputtering, an external terminal electrode whose accuracy of finishing is higher and which is more stable can be provided.

Further, according to the method of manufacturing the coil component 100 in the present embodiment, the opening pattern 32*a* of photo resist formed at an intersection of cutting lines is formed in a doughnut shape, the bump electrode member 13 is formed inside the opening pattern 32*a* and further, the center resin portion 14*m* and the corner resin portions 14*a* to 14*d* are formed by pouring a magnetic paste around the bump electrode member 13 in a doughnut shape and in a hollow portion thereof in a mass production process of manufacturing a large number of coil components and therefore, coil components having a part of the magnetic resin layer provided in corners of the bump electrodes can easily be manufactured.

Further, according to the present embodiment, the openings 25*f* to 25*i* passing through the insulating layer 15*b* to 15*d* of the thin-film coil layer 12 are formed with the opening 25*m* and filled with conductor in the process of forming conductor pattern such as spiral conductors. Accordingly, thick terminal electrode can be formed easily without undergoing a special process. Moreover, a coil component in which the formation surface of a fillet during surface mounting is adequately secured can be provided.

Figure 12:
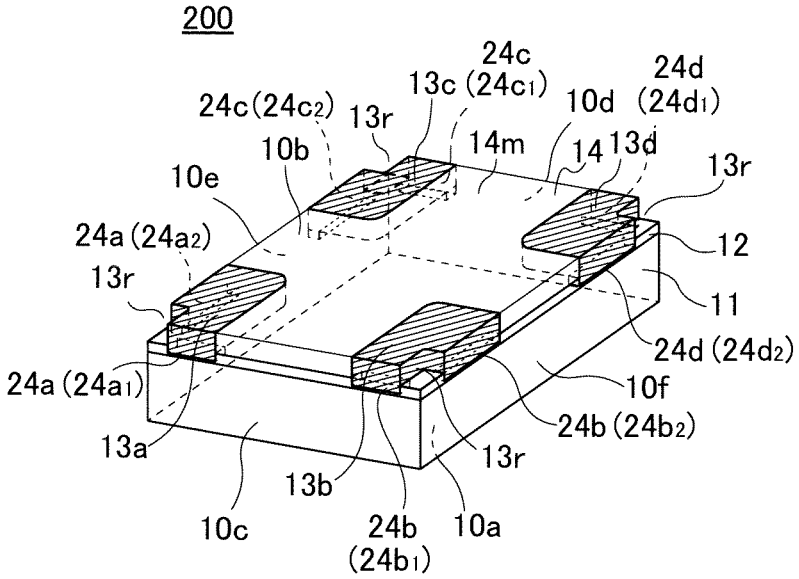
FIG. 12 is a schematic perspective view showing a structure of a coil component 200 according to a second embodiment of the present invention.

FIG. 12 is a schematic perspective view showing a structure of a coil component 200 according to a second embodiment of the present invention.

As shown in FIG. 12, the coil component 200 according to the present embodiment is characterized in that the corner resin portions 14*a* to 14*d* are removed from the coil component 100 according to the first embodiment. Thus, in the corner of each of the bump electrodes 13*a* to 13*d*, a notch portion 13*r* of the bump electrode appears. The other configuration is substantially the same as the configuration of the coil component 100 and thus, the same reference numerals are attached to the same structural elements and the detailed description is omitted. Like the coil component 100 according to the first embodiment, the coil component 200 according to the present embodiment can increase fixing strength during soldering while preventing a short-circuit between bump electrodes by a solder bridge. Particularly even a portion covered with the corner resin portion is exposed as an electrode surface and thus, fixing strength during soldering can sufficiently be increased.

The coil component 200 according to the present embodiment can be manufactured by completing the coil component 100 according to the first embodiment once and undergoing a process of removing the corner resin portions 14*a* to 14*d*. The corner resin portions 14*a* to 14*d* are removed after dicing and thus can be caused to effectively function as a member to prevent an occurrence of burrs of bump electrodes during dicing.

Figure 13:
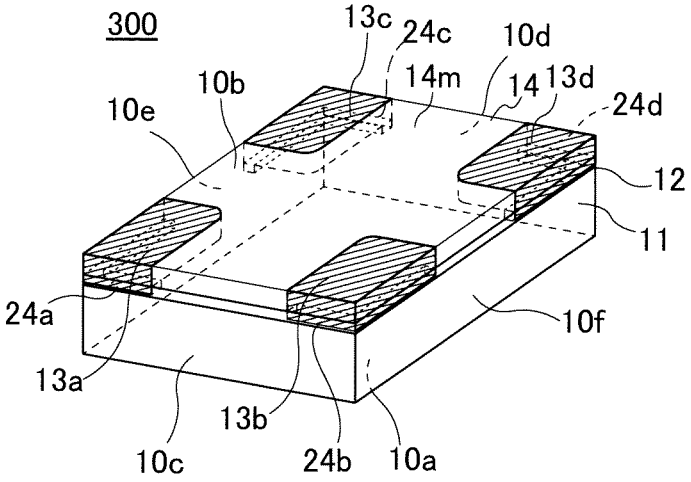
FIG. 13 is a schematic perspective view showing the structure of a coil component 300 according to a third embodiment of the present invention.

FIG. 13 is a schematic perspective view showing the structure of a coil component 300 according to a third embodiment of the present invention.

As shown in FIG. 13*a*, the coil component 300 according to the present embodiment is different from the coil component 200 according to the second embodiment in that the corner resin portions 14*a* to 14*d* are not present and further, no notch portion as a formation region of the corner resin portions 14*a* to 14*d* shown in the coil component 200 of the second embodiment is present. That is, each of the bump electrodes 13*a* to 13*d* is formed in the entire corner including the tip. With such a shape of the bump electrode, the terminal electrodes 24*a*, 24*b* have one L-shaped electrode shape having the exposure surface on two side surfaces.

As shown in FIG. 13*a*, if the bump electrode is formed in the entire corner, a burr of the bump electrode is more likely to arise during individualization of chip components. However, an occurrence burrs of the bump electrode can be prevented by the manufacturing method shown below.

Figure 14A:
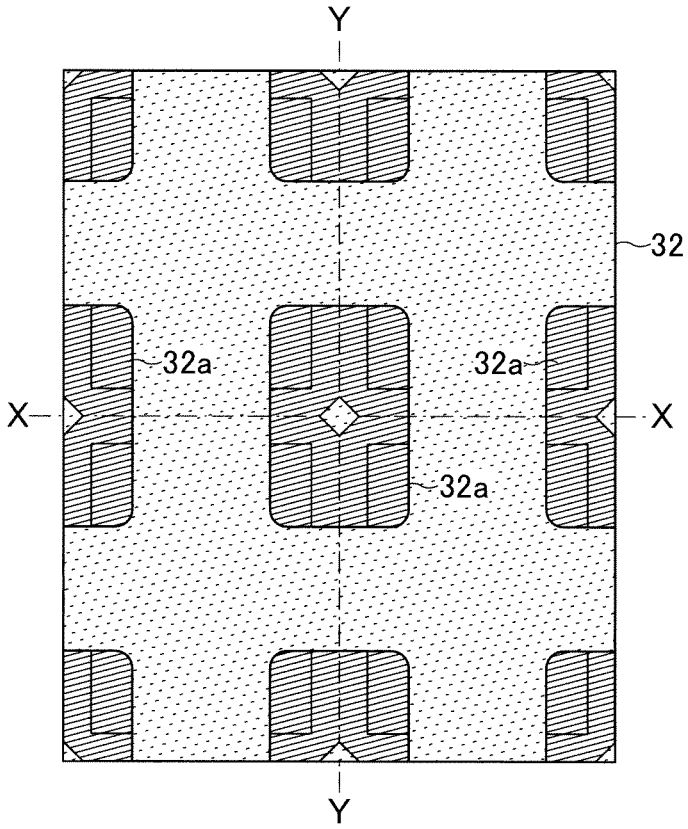
FIG. 14A is a plan view to illustrate a method of manufacturing the coil component 300 according to the third embodiment of the present invention.
Figure 14B:
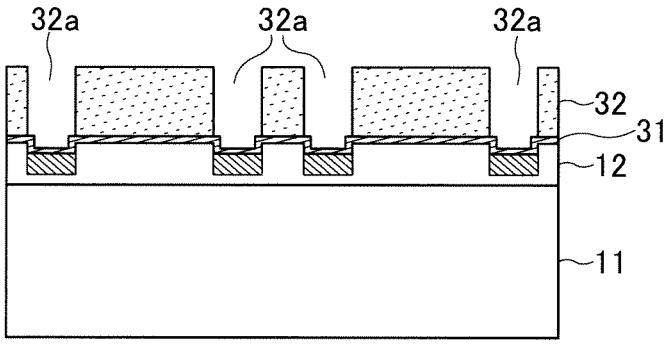
FIG. 14B is a cross-sectional views along the X-X line in FIG. 14A.
Figure 15A:
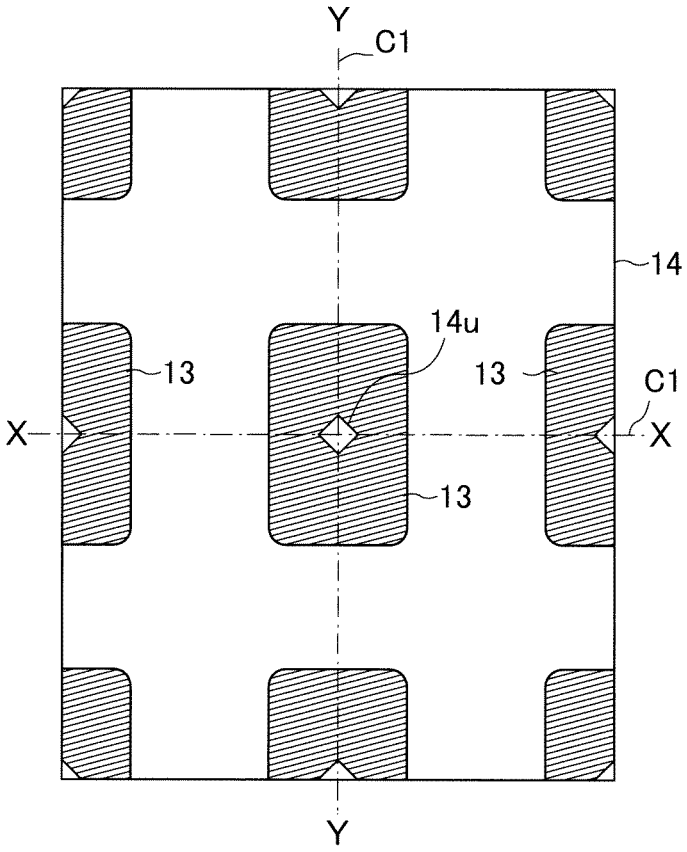
FIG. 15A is a plan view to illustrate a method of manufacturing the coil component 300 according to the third embodiment of the present invention.
Figure 15B:
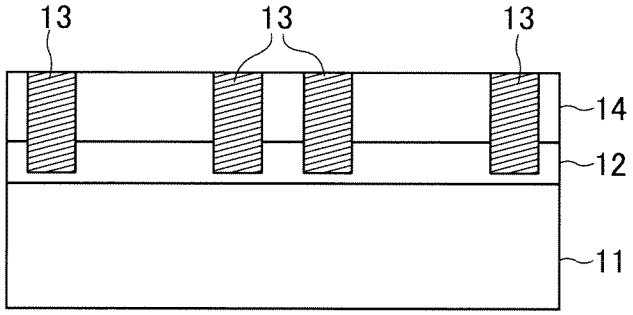
FIG. 15B is a cross-sectional views along the X-X line in FIG. 15A.

FIGS. 14 and 15 are diagrams to illustrate a method of manufacturing the coil component 300 according to the third embodiment of the present invention, FIGS. 14A and 15A are plan views, and FIGS. 14B and 15B are cross-sectional views along the X-X line in FIGS. 14A and 15A.

In the manufacture of the coil component 300, the Cu film 31 is formed by sputtering on the entire surface of the insulating layer 15*d* where the terminal electrodes 24*a* to 24*d* are exposed by undergoing the process shown in FIGS. 5 and 6 and then, the sheet resist 32 is affixed. Cu film 31 may be formed by non-electrolytic plating or vapor-deposition.

Next, as shown in FIG. 14, the sheet resist 32 in positions where the bump electrodes 13*a* to 13*d* should be formed is selectively removed by exposure and development of the sheet resist 32 to expose a bump electrode formation region on the insulating layer 15*d*.

An opening pattern 32*a* formed in the sheet resist 32 is a formation region of the bump electrode member common to four chip components allocated therearound and has a substantially annular (doughnut) shape. The region (pattern dark side) where the sheet resist 32 is left behind is a formation region of the magnetic resin layer 14, particularly the resist region left behind around the opening pattern 32*a* is a formation region of the center resin portion 14*m*, and the resist region left behind in the center in the opening pattern 32*a* is a formation region of an aggregate of the corner resin portions 14*a* to 14*d*.

In the present embodiment, the formation region of an aggregate of the corner resin portions 14*a* to 14*d* is substantially square and corners thereof are directed in the X direction and the Y direction. As will be described in detail later, the size of the square is set in such a way that half the diagonal length thereof is almost the same as the width (margin for cutting) of a cutting blade.

Then, as shown in FIG. 15, the bump electrode 13 and the magnetic resin layer 14 are formed by undergoing the process shown in FIGS. 8 to 11.

Figure 16:
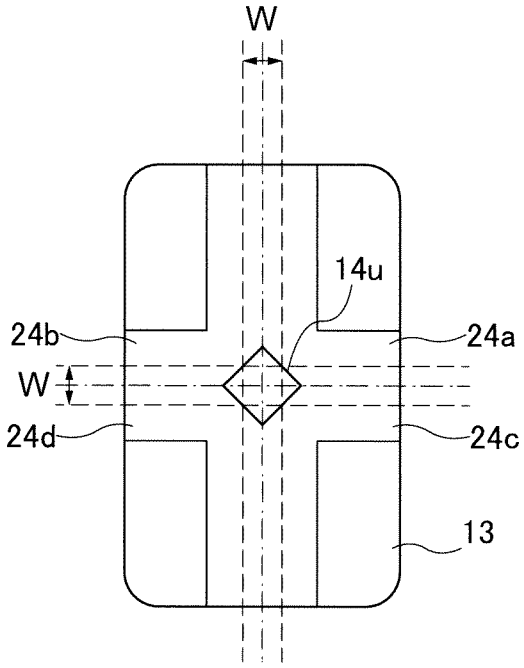
FIG. 16 is a schematic plan view illustrating a cut state of the insulating resin layer 14.

FIG. 16 is a schematic plan view illustrating a cut state of the insulating resin layer 14.

As shown in FIG. 16, the plan shape of an aggregate 14*u* of the corner resin portions 14*a* to 14*d* is substantially square and if the aggregate 14*u* is cut along the X direction and the Y direction, the aggregate 14*u* is ground by a width W of the cutting blade and disappears and no residue thereof remains. At the same time, the terminal electrodes 24*a* to 24*d* are formed as L-shaped electrodes having two exposure surfaces. Therefore, the coil component 300 as shown in FIG. 13 can be produced and because the aggregate 14*u* of the corner resin portions 14*a* to 14*d* are present during cutting, an occurrence of burrs of bump electrodes can be prevented.

Figure 17:
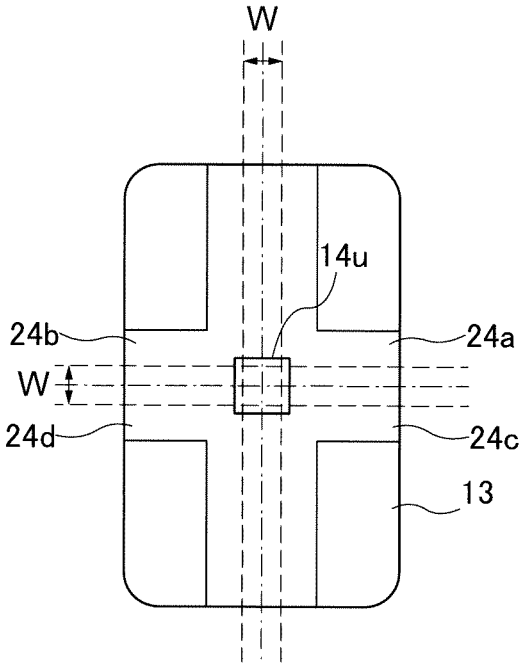
FIG. 17 is a schematic plan view illustrating the cut state of the insulating resin layer 14 based on a comparative example.

FIG. 17 is a schematic plan view illustrating the cut state of the insulating resin layer 14 based on a comparative example.

As shown in FIG. 17, in the aggregate 14*u* of the corner resin portions 14*a* to 14*d* composed of rectangular patterns whose each side is parallel to the X direction or the Y direction, if one side thereof is longer than the width W of the cutting blade, as shown in FIG. 1, the magnetic resin layer 14 remains as the corner resin portions 14*a* to 14*d* or the notch portion 13*r* of the bump electrode appears in the corner of each of the bump electrodes 13*a* to 13*d* even if the corner resin portions 14*a* to 14*d* is removed (see FIG. 12).

Figure 18:
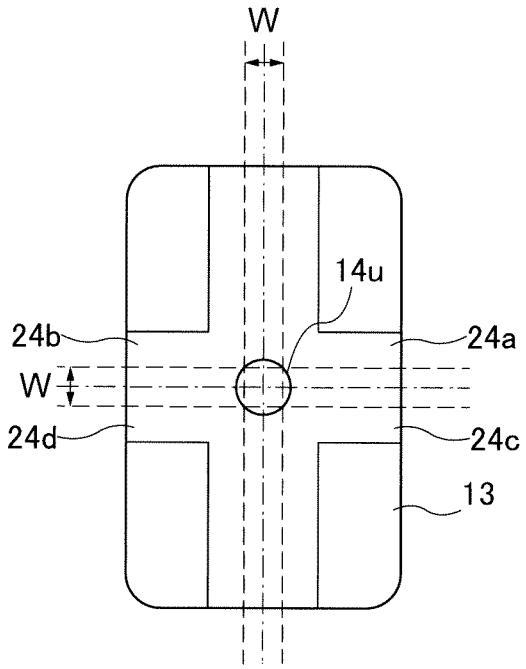
FIG. 18 is a schematic plan view showing a modification of the plane pattern of the aggregate 14*u* of the corner resin portions shown in FIG. 16.

FIG. 18 is a schematic plan view showing a modification of the plane pattern of the aggregate 14*u* of the corner resin portions shown in FIG. 16.

As shown in FIG. 18, the aggregate 14*u* of the corner resin portions is composed of circular patterns and a diameter R thereof is set to about 0.7 times ($1/\sqrt{2}$) the width W of the cutting blade. Thus, if the aggregate 14*u* is cut along the X direction and the Y direction, the aggregate 14*u* of the circular corner resin portions 14*a* to 14*d* is ground by the width W of the cutting blade and disappears and no residue thereof remains. Therefore, the coil component 300 as shown in FIG. 13 can be produced and because the aggregate 14*u* of the corner resin portions 14*a* to 14*d* is present during cutting, an occurrence of burrs of bump electrodes can be prevented.

Figure 19:
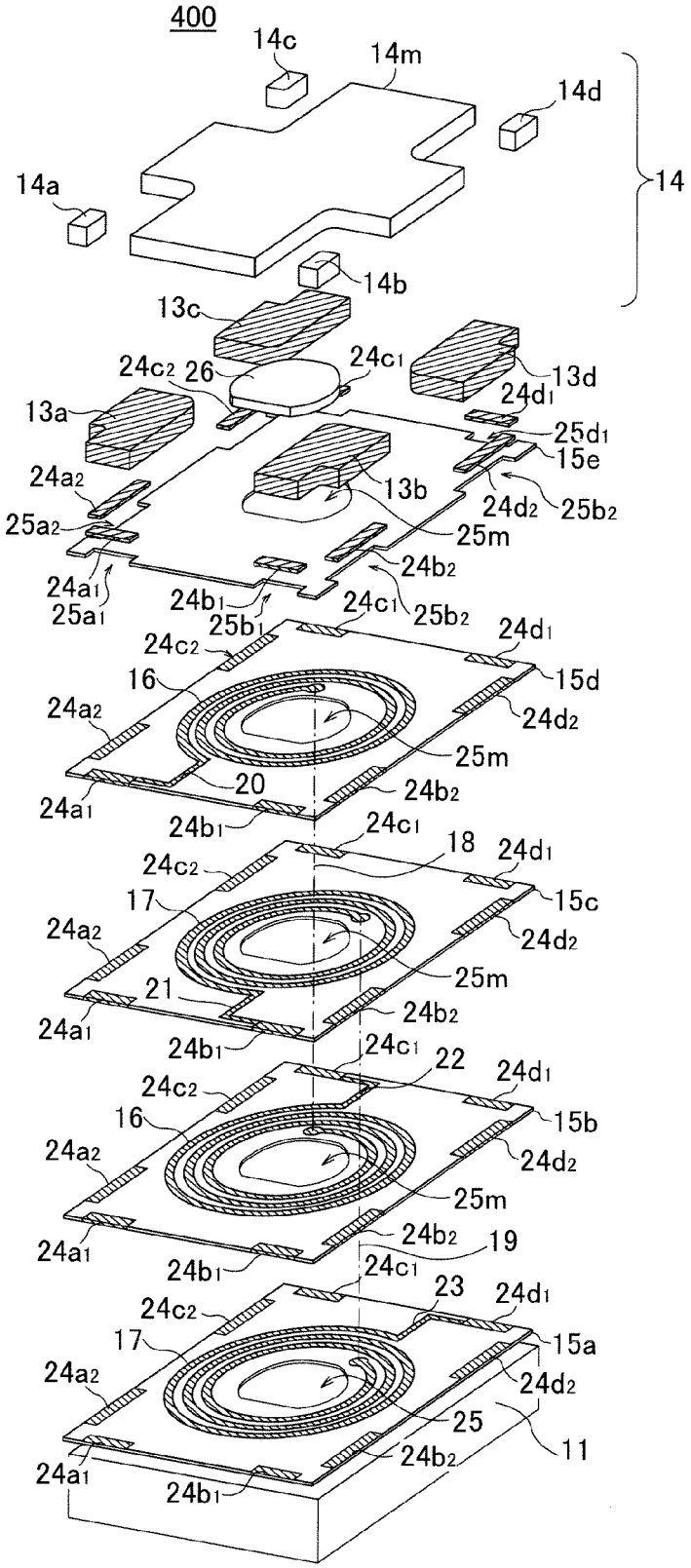
FIG. 19 is a schematic exploded perspective view showing the layer structure of a coil component 400 in detail according to a fourth embodiment of the present invention.

FIG. 19 is a schematic exploded perspective view showing the layer structure of a coil component 400 in detail according to a fourth embodiment of the present invention.

As shown in FIG. 19, the coil component 400 according to the present embodiment is characterized in that each of two coils constituting a common mode filter element is configured by a combination of two coil layers. Thus, the thin-film coil layer 12 of the coil component 400 includes insulating layers 15*a* to 15*e* stacked in order from the side of the magnetic substrate 11 toward the side of the magnetic resin layer 14, a first spiral conductor 16A formed on the insulating layer 15*c*, a second spiral conductor 16B formed on the insulating layer 15*d* and connected to the first spiral conductor 16A in series, a third spiral conductor 17A formed on the insulating layer 15*a*, and a fourth spiral conductor 17B formed on the insulating layer 15*b* and connected to the third spiral conductor 17A in series.

The internal peripheral end of the first spiral conductor 16A is connected to the internal peripheral end of the second spiral conductor 16B via the first contact hole conductor 18 passing through the insulating layers 15*c*, 15*d* and the second spiral conductor 16B circles in the same orientation as the first spiral conductor 16A from the internal peripheral end thereof toward the external peripheral end thereof and the external peripheral end thereof is connected to the electrode portion $\mathbf{24}a_1$ of the terminal electrode 24*a* via the lead conductor 20. The external peripheral end of the first spiral conductor 16A is connected to the electrode portion $\mathbf{24}c_1$ of the terminal electrode 24*c* via the third lead conductor 22 formed integrally with the first spiral conductor 16A on the insulating layer 15*b*.

The internal peripheral end of the third spiral conductor 17A is connected to the internal peripheral end of the fourth spiral conductor 17B via the second contact hole conductor 19 passing through the insulating layers 15*b*, 15*c* and the fourth spiral conductor 17B circles in the same orientation as the first to third spiral conductors 16A, 16B, 17A from the internal peripheral end thereof toward the external peripheral end thereof and the external peripheral end thereof is connected to the electrode portion $\mathbf{24}c_1$ of the terminal electrode 24*c* via the lead conductor 21. The external peripheral end of the third spiral conductor 17A is connected to the electrode portion $\mathbf{24}d_1$ of the fourth terminal electrode 24*d* via the fourth lead conductor 23 formed integrally with the third spiral conductor 17A on the insulating layer 15*a*.

It is necessary for the coil component 100 according to the first embodiment to provide the insulating layer 15*c* only to form the first and second lead conductors 20, 21 and it is difficult to effectively use the area of the insulating layer 15*c* (see FIG. 2). However, in the present embodiment, there is no insulating layer on which only a lead conductor is formed and the formation area of two coil patterns can be approximately doubled only by further increasing an insulating layer. Accordingly, the number of turns of coil formed in one layer can be reduced without changing the total number of turns and instead, DC resistance $R_{DC}$ can be reduced by making the line width of patterns wider so that common mode filter characteristics can be improved. Particularly by increasing the total number of insulating layers, the thickness of the terminal electrode can be increased so that the formation of a fillet during surface mounting can further be improved.

While preferred embodiments of the present invention have been explained above, the present invention is not limited thereto. Various modifications can be made to the embodiments without departing from the scope of the present invention and it is needless to say that such modifications are also embraced within the scope of the invention.

In the above embodiments, for example, the magnetic resin layer 14 composed of composite ferrite is formed on the principal surface of the thin-film coil layer 12, but a simple insulating resin layer having no magnetism maybe formed. The thin-film common mode filter is taken as an example of the coil component, but the present invention can be applied to various coil components of the type in which a coil conductor layer is sandwiched between upper and lower magnetic substrates.

The magnetic core 26 is provided in the above embodiments, but the magnetic core 26 is not mandatory in the present invention. However, the magnetic core 26 can be formed of the same material as the material of the magnetic resin layer 14 and thus, the magnetic core 26 and the magnetic resin layer 14 can be formed simultaneously without undergoing a special process only by forming an opening 25.

The first and second spiral conductors 16, 17 in the above embodiments are both circular spirals, but may be rectangular spirals. Even a rectangular spiral can constitute a common mode filter to achieve operations/effects of the present invention.

Barrel polishing and plating of bump electrodes are performed after dicing in the above embodiments, but these processes are not mandatory in the present invention. It is important in the present invention to form a center resin portion and corner resin portions by pouring a magnetic paste around the bump electrode member 13 in a doughnut shape and into a hollow portion thereof and accordingly, coil components in which a part of the magnetic resin layer is provided in a corner of the bump electrode can easily be manufactured.

In the fourth embodiment, as shown in FIG. 19, the second spiral conductor 17A, the first spiral conductor 16A, the fourth spiral conductor 17B, and the third spiral conductor 16B are stacked one by one from below, but the order of stacking spiral conductors is not specifically limited. Thus, for example, the second spiral conductor 17A, the fourth spiral conductor 17B, the first spiral conductor 16A, and the third spiral conductor 16B may be stacked one by one from below. Alternatively, the first spiral conductor 16A, the third spiral conductor 16B, the second spiral conductor 17A, and the fourth spiral conductor 17B may be stacked one by one from below.

The terminal electrodes 24*a* to 24*d* in the above embodiment have an exposure surface on two side surfaces of a layered product. However, the present invention is not particularly limited to such a configuration and the terminal electrodes 24*a* to 24*d* may have an exposure surface on at least one of two side surfaces of the layered product. Accordingly, for example, the terminal electrodes 24*a* to 24*d* may consist only of electrode portions $\mathbf{24}a_1$ to $\mathbf{24}d_1$ directly coupled to corresponding lead conductors 20 to 23.

What is claimed is:

1. A coil component comprising:

a magnetic substrate made of magnetic ceramic material;

a thin-film coil layer containing a coil conductor formed on one principal surface of the magnetic substrate;

a plurality of bump electrodes formed on a principal surface of the thin-film coil layer;

an insulating resin layer formed on the principal surface of the thin-film coil layer excluding formation positions of the bump electrodes, wherein:

the magnetic substrate, the thin-film coil layer and the insulating resin layer form a layered product, each of the bump electrodes has an exposure surface on a bottom surface and on two side surfaces of the layered product, the thin-film coil layer contains a plurality of terminal electrodes of the coil conductor, each of the plurality of terminal electrodes is connected to a corresponding one of the bump electrodes and has an exposure surface on at least one of the two side surfaces of the layered product, a corner of each of the bump electrodes has a notch portion; wherein the insulating resin layer includes:

a center resin portion provided at a center of the principal surface of the thin-film coil layer; and a plurality of corner resin portions, and each of the plurality of corner resin portions is provided at the notch portion of each of the bump electrodes at a corner of the principal surface of the thin-film coil layer, and is separated by the each of the bump electrode from the center resin portion.

2. The coil component as claimed in claim 1, wherein each terminal electrode has the exposure surface on both of the two side surfaces of the layered product.

3. The coil component as claimed in claim 1, wherein each terminal electrode includes a first electrode portion directly connected to the coil conductor without being connected via the corresponding one of the bump electrodes and a second electrode portion connected to the coil conductor via the corresponding one of the bump electrodes, the first electrode portion has the exposure surface on one of the two side surfaces, and the second electrode portion has the exposure surface on the other of the two side surfaces.

4. The coil component as claimed in claim 1, wherein:

the thin-film coil layer includes:

a multilayered insulating member containing first and second insulating layers;

a first spiral conductor formed on a surface of the first insulating layer; and a second spiral conductor formed on a surface of the second insulating layer, the coil conductor constitutes a common mode filter including the first and second spiral conductors that mutually couple magnetically, and each of the plurality of terminal electrodes is embedded in the multilayered insulating member.

5. The coil component as claimed in claim 3, wherein:

a width of the first electrode portion in a first direction perpendicular to a longitudinal direction of the first electrode portion is smaller than that of the bump electrode in a same direction, and a width of the second electrode portion in a second direction perpendicular to a longitudinal direction of the second electrode portion is smaller than that of the bump electrode in a same direction.

6. The coil component as claimed in claim 1, wherein a thickness of each of the bump electrodes is larger than that of the coil conductor.

7. The coil component as claimed in claim 1, wherein the bump electrodes are formed by plating.

8. The coil component as claimed in claim 1, wherein the exposure surface on the bottom surface of each of the bump electrodes is flush with a principal surface of the insulating resin layer.

9. The coil component as claimed in claim 1, wherein the insulating resin layer has a notch portion at a corner of the insulating resin layer.

10. The coil component as claimed in claim 1, wherein the insulating resin layer includes a magnetic material.

* * * * *